US012656047B2

(12) United States Patent
Lee et al.

(10) Patent No.: US 12,656,047 B2
(45) Date of Patent: Jun. 16, 2026

(54) REFRIGERATOR

(71) Applicant: Samsung Electronics Co., Ltd., Suwon-si (KR)

(72) Inventors: Chomin Lee, Suwon-si (KR); Yangyeol Gu, Suwon-si (KR); Seongwoo Kim, Suwon-si (KR); Chanbin Park, Suwon-si (KR); Yongman Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 380 days.

(21) Appl. No.: 18/320,141

(22) Filed: May 18, 2023

(65) Prior Publication Data

US 2023/0288128 A1 Sep. 14, 2023

Related U.S. Application Data

(63) Continuation of application No. PCT/KR2021/012955, filed on Sep. 23, 2021.

(30) Foreign Application Priority Data

Nov. 18, 2020 (KR) ..... 10-2020-0154341
Jun. 21, 2021 (KR) ..... 10-2021-0080154

(51) Int. Cl.
*F25D 23/02* (2006.01)

(52) U.S. Cl.
CPC ..... *F25D 23/02* (2013.01); *F25D 2400/18* (2013.01)

(58) Field of Classification Search
CPC .... F25D 23/028; F25D 2400/18; F25D 23/02; F25D 23/085; A47B 2096/208; A47B 96/201; A47L 15/4265
See application file for complete search history.

(56) References Cited

U.S. PATENT DOCUMENTS 9,500,402 B2 * 11/2016 Kim ..... F25D 23/02
11,287,174 B2 3/2022 Lee et al.
(Continued)

FOREIGN PATENT DOCUMENTS

CN 207299701 U * 5/2018
EP 2484996 A1 * 8/2012 ..... F25D 23/065
(Continued)

OTHER PUBLICATIONS

International Search Report and Written Opinion of the International Searching Authority dated Jan. 11, 2022, in connection with International Application No. PCT/KR2021/012955, 8 pages.

*Primary Examiner* — Hiwot E Tefera

(57) ABSTRACT

Disclosed herein is a refrigerator capable of fixing a door panel to a door body by using a sliding trim. The refrigerator comprises: a main body provided to form a storage compartment; and a door configured to open and close the storage compartment. The door comprises: a door body comprising a first chassis and a second chassis provided to form opposite side surfaces; a door panel detachably mounted on the door body, and comprising a first side trim provided at a rear surface of the door panel and provided to be rotatably coupled to the first chassis and a second side trim spaced apart from the second chassis by a predetermined distance so as to form a sliding groove; and a sliding trim inserted into the sliding groove by sliding with respect to the door body and the door panel, and provided to fix the second side trim to the door body.

20 Claims, 23 Drawing Sheets

(56) References Cited

U.S. PATENT DOCUMENTS

2005/0006997 A1* 1/2005 Yoshioka ..... F25D 23/02 312/405
2007/0188059 A1* 8/2007 Davis ..... F24C 15/045 312/265.6
2008/0036350 A1* 2/2008 Crompton ..... F25D 23/02 312/405
2008/0143227 A1* 6/2008 Kim ..... F25D 23/02 312/405
2009/0045705 A1 2/2009 Laible et al.
2010/0031580 A1* 2/2010 Lee ..... B29C 65/7811 49/504
2010/0170290 A1* 7/2010 Arzoz Barandalla ..... F25D 23/028 62/449
2010/0270901 A1* 10/2010 Kim ..... F25D 23/02 312/405
2011/0089790 A1* 4/2011 Lee ..... F25D 23/02 29/890.035
2011/0273071 A1* 11/2011 Kim ..... F25D 23/028 312/405
2017/0176091 A1* 6/2017 Becke ..... F25D 29/005
2017/0184336 A1* 6/2017 Becke ..... F25D 23/028
2017/0370631 A1* 12/2017 Kim ..... F25D 23/006
2018/0187955 A1* 7/2018 Son ..... F25D 23/028
2020/0060437 A1 2/2020 Artwohl et al.
2020/0326119 A1* 10/2020 Lee ..... F25D 23/02
2021/0372688 A1* 12/2021 Kang ..... A47B 96/20

FOREIGN PATENT DOCUMENTS

FR 2334928 A * 8/1977
JP 1993-059184 U 8/1993
JP 5978520 B2 8/2016
JP 2016156556 A * 9/2016
JP 2017-187275 A 10/2017
JP 2019-148421 A 9/2019
KR 10-0644253 B1 11/2006
KR 10-0692223 B1 3/2007
KR 10-1132461 B1 3/2012
KR 10-1132499 B1 4/2012
KR 101520691 B1 * 5/2015 ..... F25D 23/028
KR 10-2020-0121219 A 10/2020
KR 10-2020-0133308 A 11/2020

* cited by examiner

REFRIGERATOR

CROSS-REFERENCE TO RELATED APPLICATIONS

This application is a bypass continuation of International Application No. PCT/KR2021/012955, filed Sep. 23, 2021, which claims priority to Korean Patent Application No. 10-2020-0154341, filed Nov. 18, 2020, and Korean Patent Application No. 10-2021-0080154, filed Jun. 21, 2021, the disclosures of which are herein incorporated by reference in their entirety.

BACKGROUND

1. Field

The present disclosure relates to a refrigerator, and more particularly, to a refrigerator including an improved door structure.

2. Description of Related Art

A refrigerator is a device that is composed of a main body including a storage compartment, and a cold air supply system configured to supply cold air to the storage compartment so as to keep food fresh. The storage compartment includes a refrigerating compartment maintained at approximately 0 to 5° C. to store food in a refrigerated manner, and a freezing compartment maintained at approximately 0 to −30° C. to store food in a frozen manner. In general, the storage compartment includes an open front surface and the open front surface is opened and closed by a door.

The refrigerator may be classified according to the shape of the storage compartment and the door. The refrigerator may be classified into a Top Mounted Freezer (TMF) refrigerator in which a storage compartment is partitioned vertically by horizontal partition walls to form a freezing compartment on an upper side and a refrigerating compartment on a lower side, and a Bottom Mounted Freezer (BMF) refrigerator in which a freezing compartment is formed on a lower side and a refrigerating compartment is formed on an upper side. Further, the refrigerator may be classified into a Side by Side (SBS) refrigerator in which a storage compartment is divided into left and right sides by vertical partition walls to form a freezing compartment on one side and a refrigerating compartment on the other side, and a French Door Refrigerator (FDR) in which a storage compartment is partitioned vertically by horizontal partition walls to form a refrigerating compartment on an upper side and a freezing compartment on a lower side, and the refrigerating compartment is opened and closed by a pair of doors.

SUMMARY

The present disclosure is directed to providing a refrigerator capable of easily changing a design of a door.

Further, the present disclosure is directed to providing a refrigerator capable of fixing a door panel to a door body by slidingly coupling a sliding trim to the door panel and the door body.

One aspect of the present disclosure provides a refrigerator including a main body provided to form a storage compartment, and a door configured to open and close the storage compartment. The door includes a door body including a first chassis and a second chassis provided to form opposite side surfaces, a door panel detachably mounted on the door body, and including a first side trim provided at a rear surface of the door panel and configured to be coupled to the first chassis by rotating with respect to the first chassis, and a second side trim spaced apart from the second chassis by a predetermined distance so as to form a sliding groove, and a sliding trim inserted into the sliding groove by sliding with respect to the door body and the door panel, and provided to fix the second side trim to the door body.

The sliding trim may be inserted into the sliding groove to cover a separation space between the second side trim and the second chassis so as to prevent the separation space from being exposed to an outside.

The sliding trim may include a sliding body inserted into the sliding groove, a cover member extending from the sliding body to cover the separation space, a first sliding protrusion extending from the sliding body to be coupled to the second side trim, and a second sliding protrusion extending from the sliding body to be coupled to the second chassis.

The sliding body may be provided parallel to one side surface of the door body formed by the second chassis.

The first sliding protrusion may extend from the sliding body in a first direction.

The second sliding protrusion may extend from the sliding body in a second direction opposite to the first direction.

The sliding trim may further include a cover protrusion protruding from a rear surface of the cover member to be coupled to the second chassis.

The second chassis may include a support protrusion provided to support the sliding body and the second sliding protrusion, and a first groove into which the cover protrusion is inserted.

The second side trim may include a second groove into which the first sliding protrusion is inserted.

The first side trim may include a trim body fixed to the door panel, a trim protrusion extending from the trim body to a rear side of the door panel, and a trim groove formed by laterally recessing a portion of the trim protrusion.

The first chassis may include a chassis protrusion inserted into the trim groove to support the first side trim.

The first side trim may be rotated with respect to the first chassis so as to allow the chassis protrusion to be inserted into the trim groove.

The door panel may further include an upper trim arranged on an upper edge of a rear surface, and a lower trim arranged on a lower edge of the rear surface.

The door body may further include an upper door cap coupled to the upper trim, and a lower door cap coupled to the lower trim.

The lower trim may include a lower trim groove.

The lower door cap may include a lower cap protrusion inserted into the lower trim groove, and provided to support the lower trim to limit a forward and backward movement of the lower trim in response to the lower cap protrusion being inserted into the lower trim groove.

The lower cap protrusion may be inserted into the lower trim groove as the door panel is moved downward with respect to the door body in a state in which the door panel is in close contact with the door body.

The upper trim may include an upper trim protrusion.

In response to the door panel being mounted on the door body, a separation space may be formed between an upper end of the door panel and the upper door cap.

The refrigerator may further include a fixing trim mounted to the separation space and including a fixing groove into which the upper trim protrusion is inserted, the fixing trim provided to fix the upper end of the door panel to the door body in response to the upper trim protrusion being inserted into the fixing groove.

The door body may further include a cover provided to form a front surface of the door body.

The first side trim may include a magnetic material so as to be coupled to the cover by a magnetic force.

The first side trim may include a trim body fixed to the door panel, a trim protrusion extending from the trim body to a rear side of the door panel, and a trim insert provided at an end of the trim protrusion and having a larger width than the trim protrusion.

The first chassis may include an insert groove into which the trim insert is inserted.

The door panel may include a panel body formed of a metal material, a first panel bending member formed by bending one side end of the panel body backward, and a second panel bending member formed by bending the other side end of the panel body backward.

The first side trim may be formed by bending an end of the first panel bending member.

The second side trim may be formed by bending an end of the second panel bending member.

Another aspect of the present disclosure provides a refrigerator including a main body provided to form a storage compartment, and a door configured to open and close the storage compartment. The door includes a door body, a door panel detachably mounted on the door body, and a sliding trim provided to fix the door panel to the door body. The door panel includes a first side trim arranged on one side of a rear surface of the door panel so as to rotate together with the door panel, and provided to fix one side of the door panel to the door body by rotating with respect to one side of the door body, and a second side trim arranged on the other side of the rear surface of the door panel and including a groove, the second side trim spaced apart from the door body by a predetermined distance. The sliding trim includes a sliding protrusion provided to be inserted into the groove. As the sliding protrusion slides against the second side trim and the door body so as to be inserted into the groove, the sliding protrusion fixes the other side of the door panel to the door body.

The sliding trim may be arranged in a separation space between the second side trim and the door body to cover the separation space to prevent the separation space from being exposed to an outside.

The sliding protrusion may be a first sliding protrusion.

The sliding trim may further include a sliding body, a cover member extending from the sliding body to cover the separation space, and a second sliding protrusion extending from the sliding body to be coupled to the door body.

The door panel may further include an upper trim arranged on an upper edge of the rear surface, and a lower trim arranged on a lower edge of the rear surface.

The door body may include an upper door cap coupled to the upper trim and a lower door cap coupled to the lower trim.

The lower trim may include a lower trim groove.

The lower door cap may include a lower cap protrusion inserted into the lower trim groove, and provided to support the lower trim to limit a forward and backward movement of the lower trim in response to the lower cap protrusion being inserted into the lower trim groove.

The lower cap protrusion may be inserted into the lower trim groove as the door panel is moved downward with respect to the door body in a state in which the door panel is in close contact with the door body.

A refrigerator may easily change a design of a door by including a door panel detachably mounted on a door body.

Further, a refrigerator may fix a door panel to a door body by slidingly coupling a sliding trim to the door panel and the door body.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
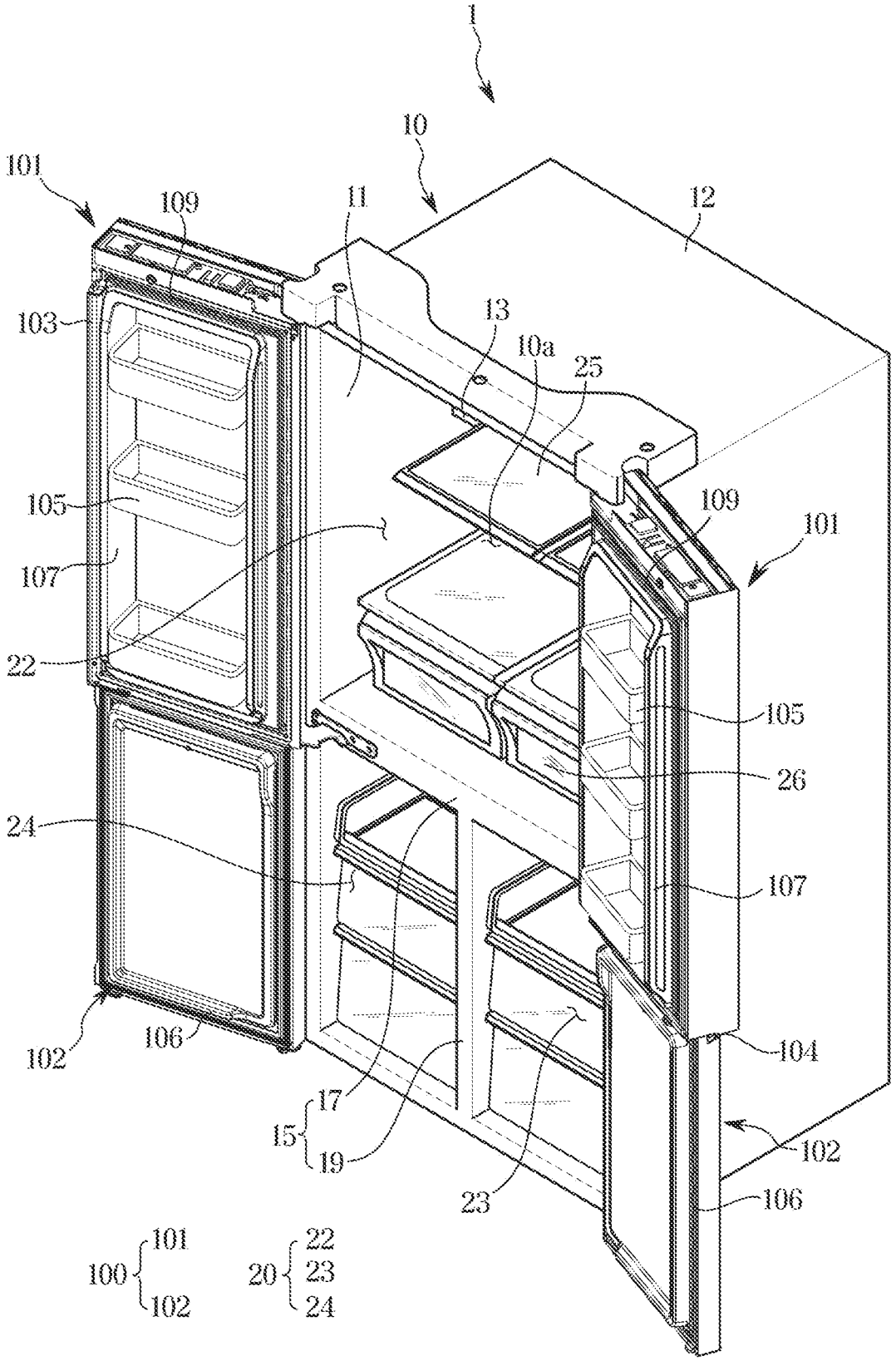
FIG. 1 illustrates a refrigerator according to one embodiment of the present disclosure.

FIGS. 1 through 23, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof. Shapes and sizes of elements in the drawings may be exaggerated for clear description.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side", and the like may be defined by the drawings, but the shape and the location of the component is not limited by the term.

The disclosure will be described more fully hereinafter with reference to the accompanying drawings.

FIG. 1 illustrates a refrigerator according to one embodiment of the present disclosure.

Referring to FIG. 1, a refrigerator may include a main body 10, a storage compartment 20 vertically partitioned inside the main body 10, a door 100 configured to open and close the storage compartment 20, and a cold air supply device (not shown) configured to supply cold air to the storage compartment 20.

The main body 10 may include an inner case 11 forming the storage compartment 20, an outer case 12 coupled to an outside of the inner case 11 to form an exterior, and a main body insulating material (not shown) foamed between the inner case and the outer case to insulate the storage compartment 20.

The cold air supply device may generate cold air by using a refrigerant circulation cycle in which a refrigerant is compressed, condensed, expanded, and evaporated.

The storage compartment 20 may be divided into a plurality by a partition 15, and a plurality of shelves 25 and storage containers 26 may be provided in the storage compartment 20 to store food and the like.

The storage compartment 20 may be divided into a plurality of storage compartments 22, 23, and 24 by the partition 15, and the partition 15 may include a first partition 17 horizontally coupled to the inside of the storage compartment 20 to divide the storage compartment 20 into an upper storage compartment (a first storage compartment) 22 and lower storage compartments 23 and 24, and a second partition 19 vertically coupled to the inside of the lower storage compartments 23 and 24 to divide the lower storage compartments 23 and 24 into a second storage compartment 23 and a third storage compartment 24.

The partition 15 having a T-shape formed by the first partition 17 and the second partition 19 coupled to each other may divide the storage compartment 20 into three spaces. Among the upper storage compartment 22 and the lower storage compartments 23 and 24 divided by the first partition 17, the upper storage compartment 22 may be used as a refrigerating compartment, and the lower storage compartments 23 and 24 may be used as a freezing compartment.

All the lower storage compartments 23 and 24 may be used as the freezing compartment. Alternatively, the second storage compartment 23 may be used as the freezing compartment and the third storage compartment 24 may be used as the refrigerating compartment. Alternatively, the second storage compartment 23 may be used as the freezing compartment, and the third storage compartment 24 may be used as both of the freezing compartment and the refrigerating compartment.

The division of the storage compartment 20 as described above is an example, and each storage compartment 22, 23, and 24 may be used differently from the above configuration.

The storage compartment 20 may be opened and closed by the door 100. The door 100 may include a pair of first doors (or upper doors) 101 configured open and close the upper storage compartment 22 and a pair of second doors (or lower doors) 102 configured to open and close the lower storage compartments 23 and 24. The pair of first doors 101 and the pair of second doors 102 may open and close an opened main body opening 10*a* of the main body 10.

A rotating bar 103 may be provided on one of the pair of first doors 101. The rotating bar 103 may seal a gap between the pair of first doors 101 when the pair of first doors 101 are closed. A rotating bar guide 13 provided to guide a movement of the rotating bar 103 may be provided in the main body 10.

Hereinafter for convenience of description, only one first door 101 and one second door 102 will be described, and descriptions of the remaining first door 101 and second door 102 will be omitted. However, except that the first door 101 and the second door 102, which are not described, are provided in mirror symmetry with the first door 101 and the second door 102 described below, respectively, a configuration of the first door 101 and the second door 102, which are not described, may be substantially the same as a configuration of the first door 101 and the second door 102 described below. In addition, the same configuration as that of the first door 101 may be applied to the second door 102, and a detailed description of the configuration of the second door 102 the same as those of the first door 101 will be omitted.

The upper storage compartment 22 may be opened and closed by the first door 101 rotatably coupled to the main body 10. The first door 101 may be opened and closed through a first door handle (not shown). The first door handle may be recessed on a bottom surface of the first door 101.

A door shelf 105 provided to store food may be arranged on a rear surface of the first door 101. The door shelf 105 may include a shelf support 107 extending vertically from the first door 101 to support the door shelf 105 at both left and right sides of the door shelf 105. The shelf support 107 may be provide as a separate component and then removably mounted to the first door 101, and in the embodiment, the shelf support 107 is provided to protrude rearward from the rear surface of the first door 101 and extend vertically.

A first gasket 109 may be provided at a rear edge of the first door 101 to seal a gap with the main body 10 when the first door 101 is closed. The first gasket 109 may be installed in a loop shape along an edge on the rear surface of the first door 101, and a first magnet (not shown) may be included in the first gasket 109.

The lower storage compartments 23 and 24 may be opened and closed by the second door 102 rotatably coupled to the main body 10. The second door 102 may be opened and closed through a second door handle 104. The second door handle 104 may be recessed on an upper surface of the second door 102. Although not shown, the second door 102 may be provided in a sliding manner.

A second gasket 106 may be provided at a rear edge of the second door 102 to seal a gap with the main body 10 when the second door 102 is closed. The second gasket 106 may be installed in a loop shape along an edge on the rear surface of the second door 102, and a second magnet (not shown) may be included in the second gasket 106.

Figure 2:
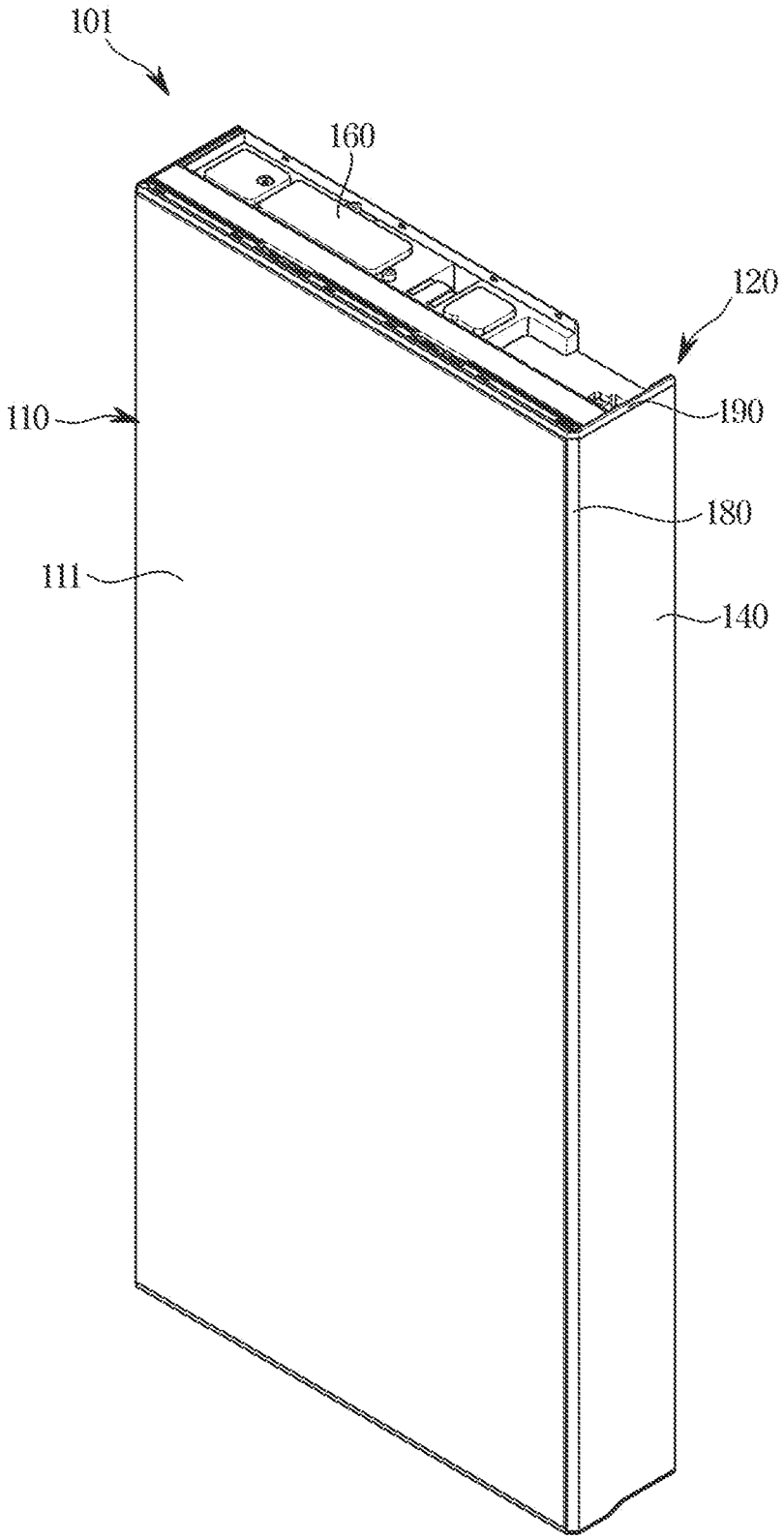
FIG. 2 illustrates a first door shown in FIG. 1.
Figure 3:
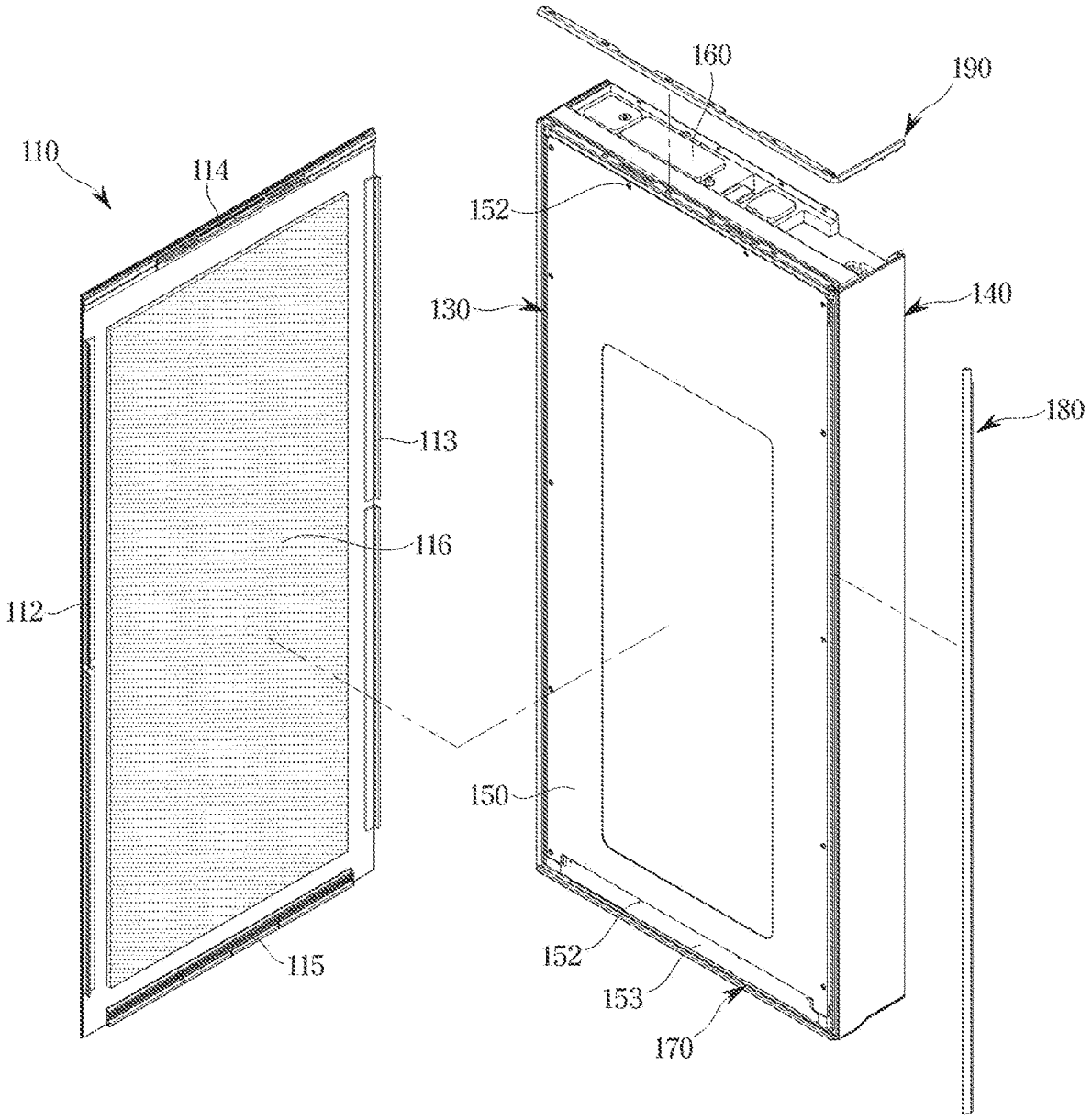
FIG. 3 is a view illustrating a door panel of the first door shown in FIG. 2 disassembled from a door body.
Figure 4:
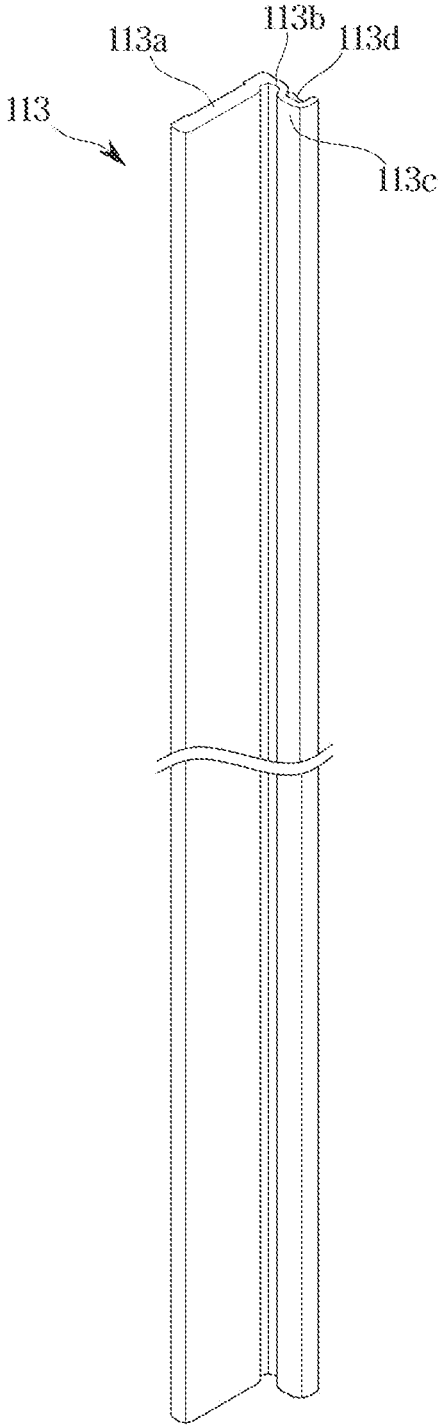
FIG. 4 illustrates a first side trim shown in FIG. 3.
Figure 5:
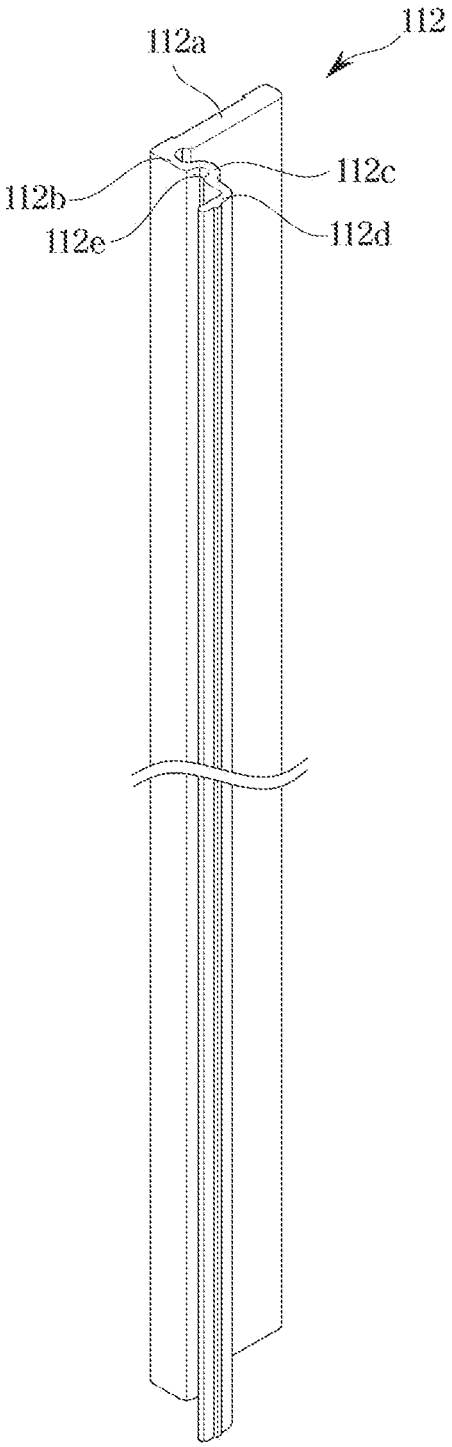
FIG. 5 illustrates a second side trim shown in FIG. 3.
Figure 6:
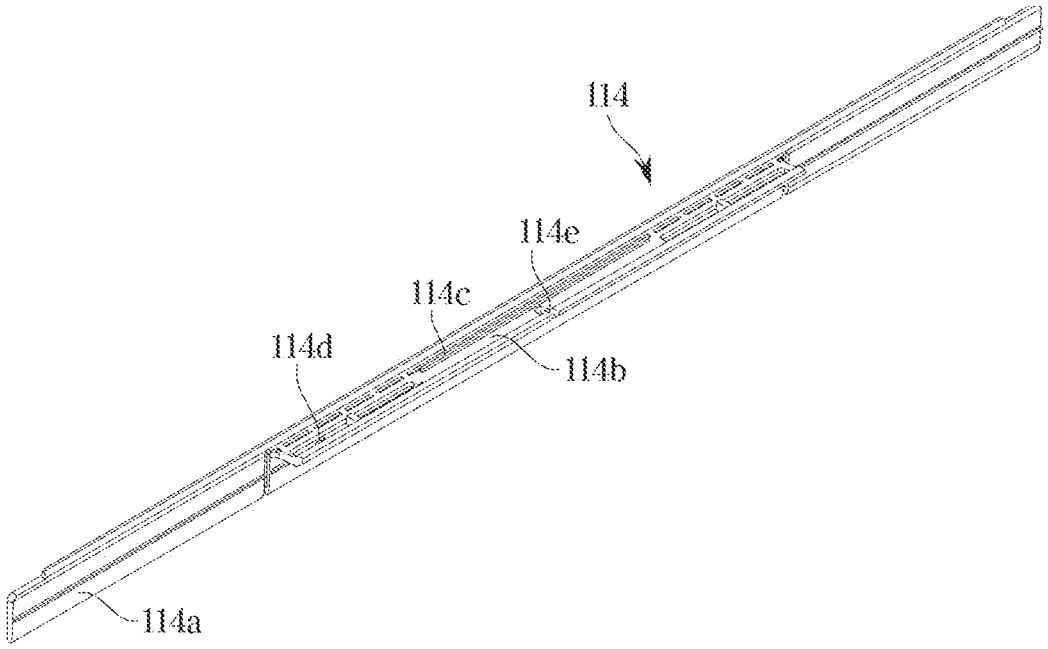
FIG. 6 illustrates a lower trim shown in FIG. 3.
Figure 7:
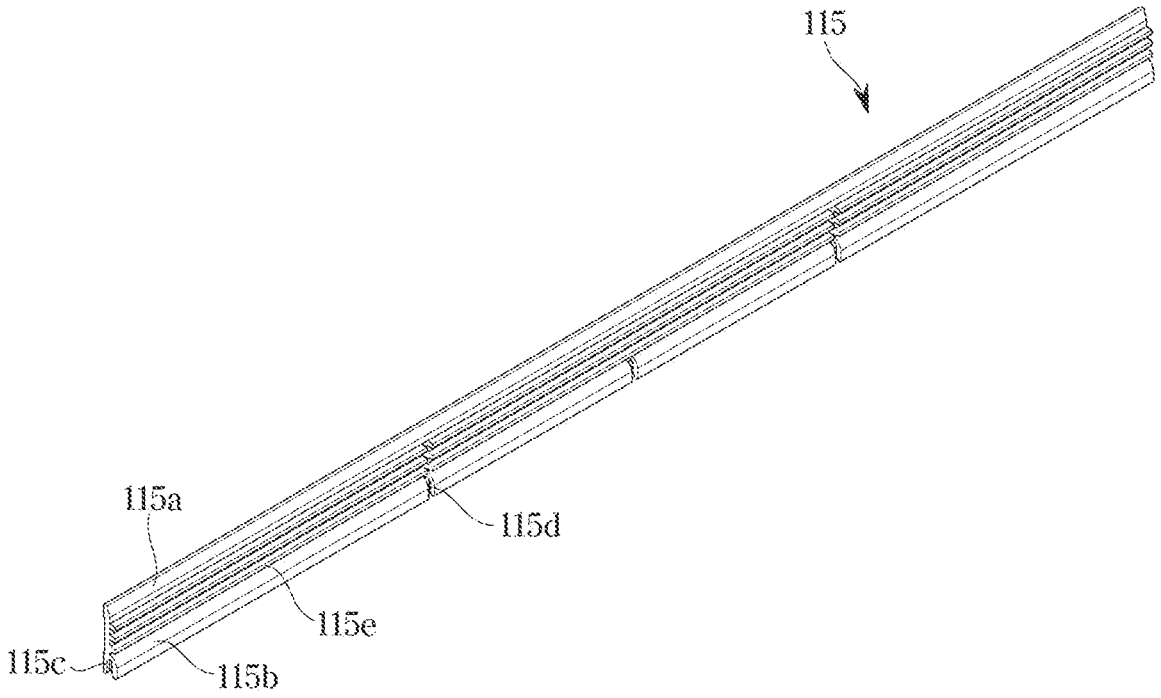
FIG. 7 illustrates an upper trim shown in FIG. 3.
Figure 8:
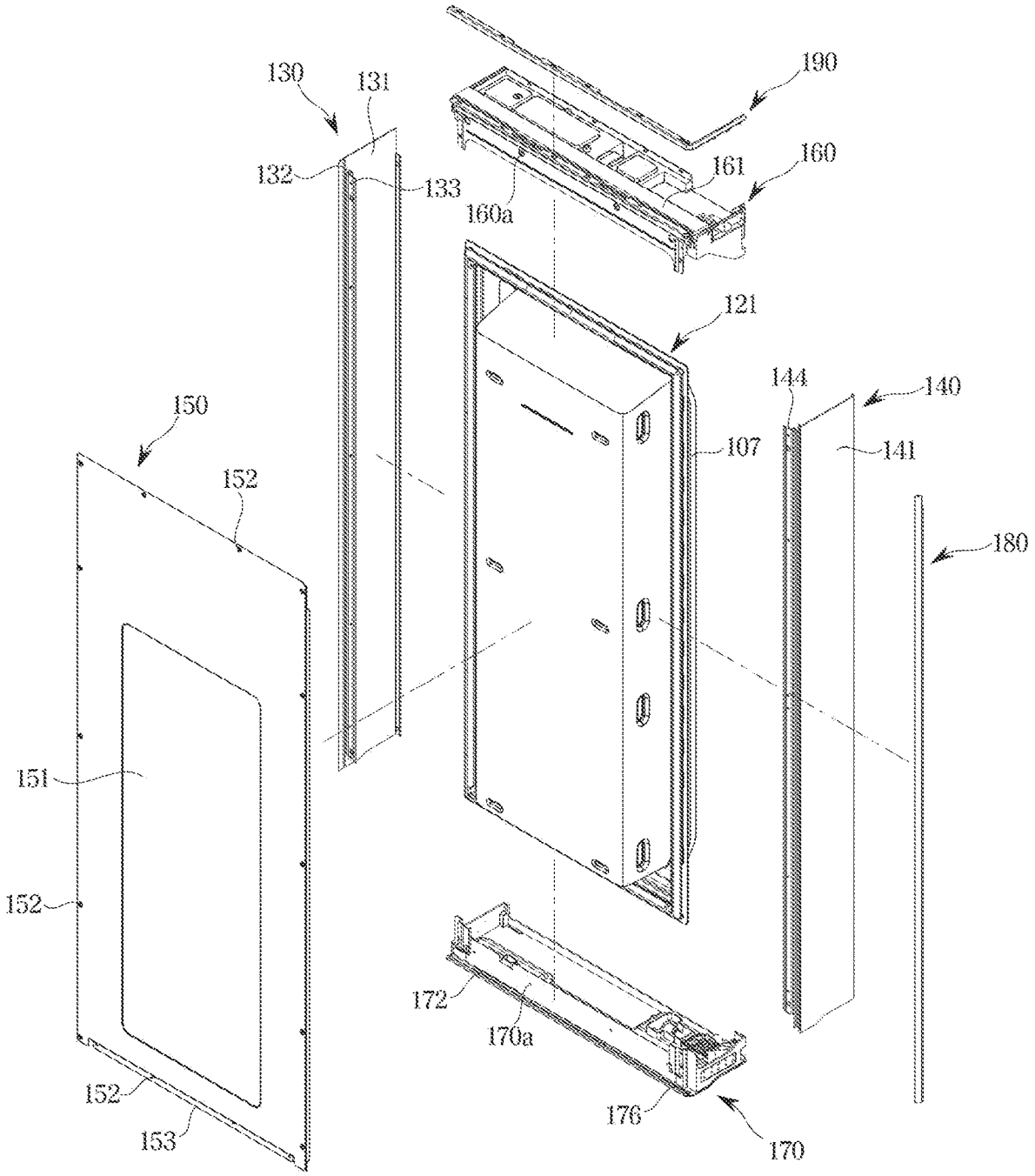
FIG. 8 illustrates an exploded view of the door body shown in FIG. 3.
Figure 9:
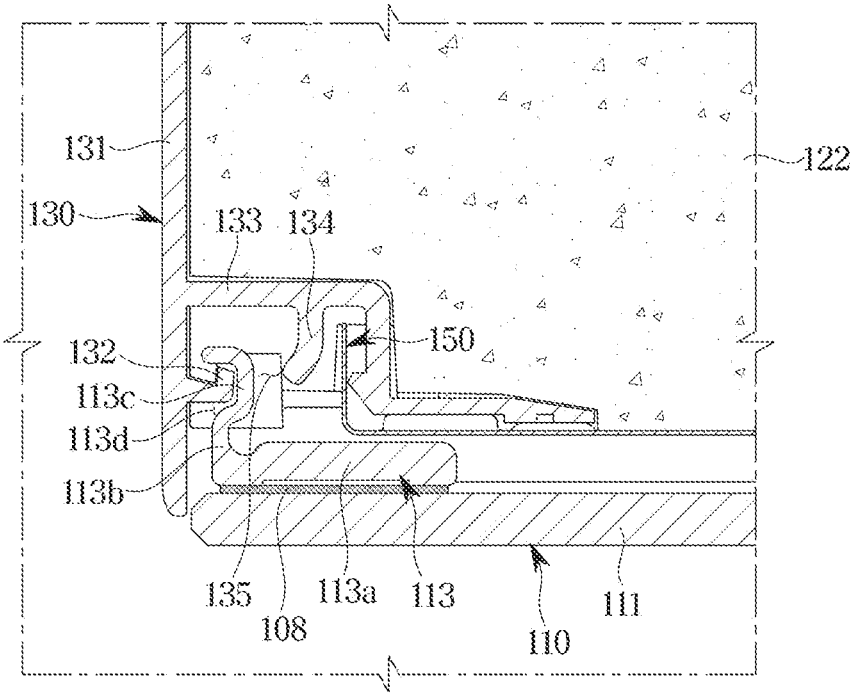
FIG. 9 illustrates a cross-sectional view of a state in which the first side trim shown in FIG. 3 is coupled to the door body.
Figure 10:
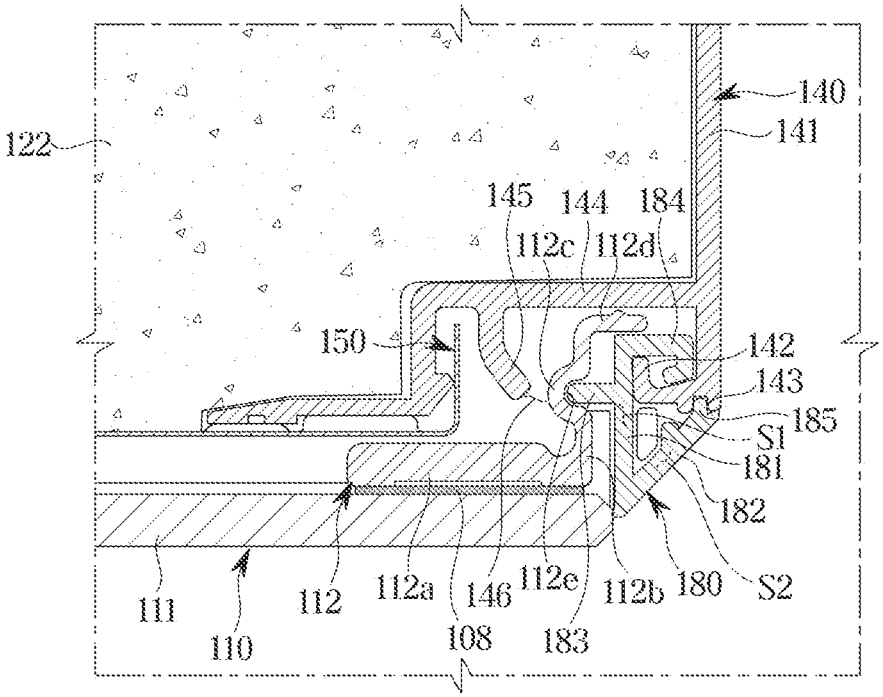
FIG. 10 illustrates a cross-sectional view of a state in which the second side trim and the sliding trim shown in FIG. 3 are coupled to the door body.
Figure 11:
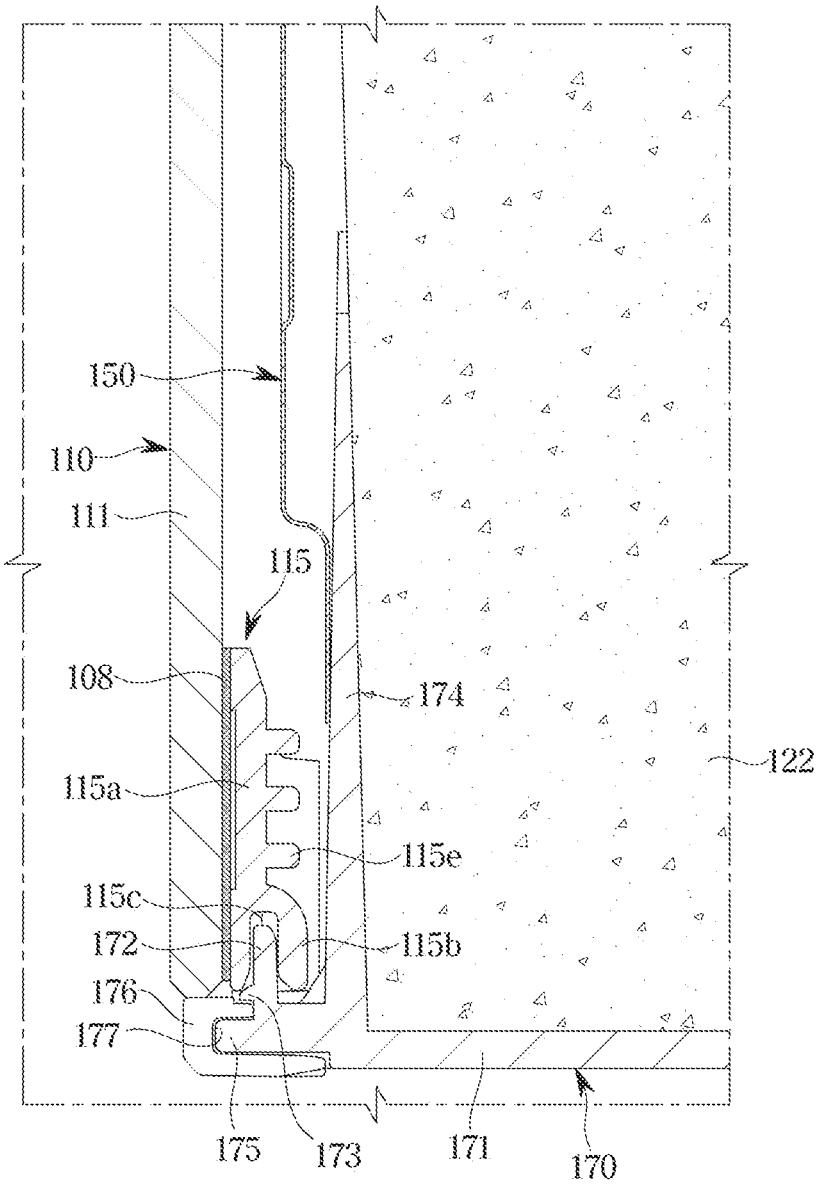
FIG. 11 illustrates a cross-sectional view of a state in which the lower trim shown in FIG. 3 is coupled to the door body.
Figure 12:
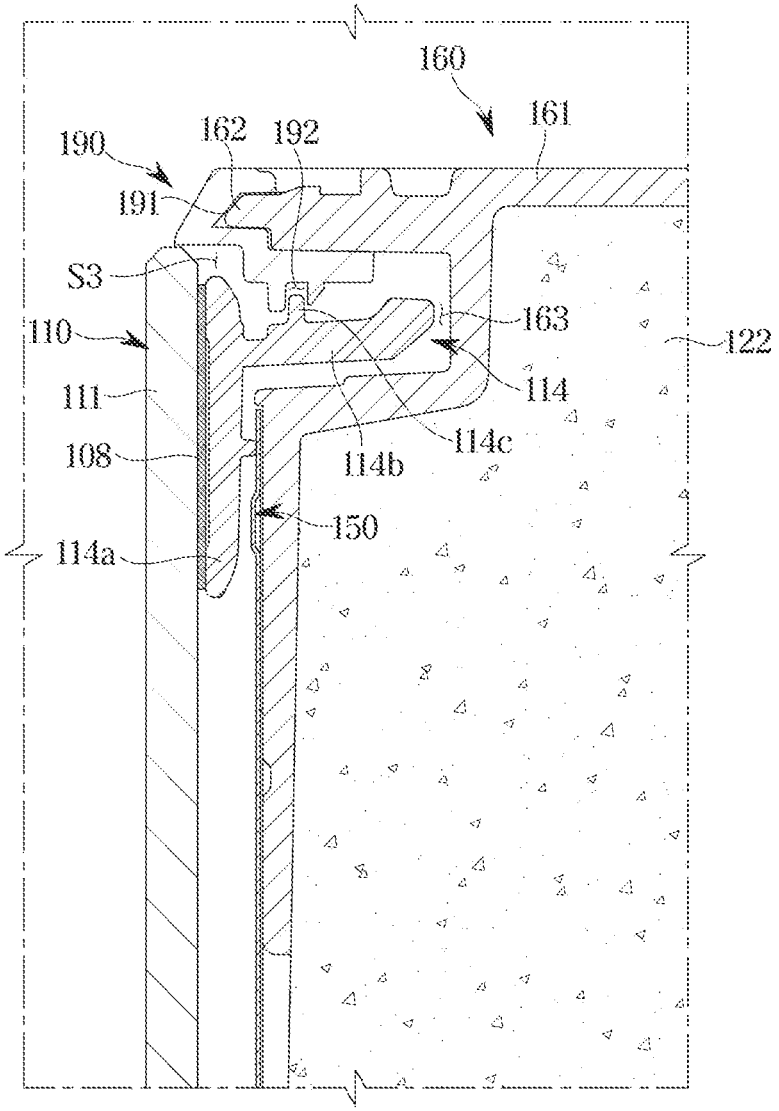
FIG. 12 illustrates a cross-sectional view of a state in which the upper trim and a fixing trim shown in FIG. 3 are coupled to the door body.

FIG. 2 illustrates a first door shown in FIG. 1. FIG. 3 illustrates a door panel of the first door shown in FIG. 2 disassembled from a door body. FIG. 4 illustrates a first side trim shown in FIG. 3. FIG. 5 illustrates a second side trim shown in FIG. 3. FIG. 6 illustrates a lower trim shown in FIG. 3. FIG. 7 illustrates an upper trim shown in FIG. 3. FIG. 8 is an exploded view of the door body shown in FIG. 3. FIG. 9 illustrates a cross-sectional view of a state in which the first side trim shown in FIG. 3 is coupled to the door body. FIG. 10 illustrates a cross-sectional view of a state in which the second side trim and the sliding trim shown in FIG. 3 are coupled to the door body. FIG. 11 illustrates a cross-sectional view of a state in which the lower trim shown in FIG. 3 is coupled to the door body. FIG. 12 illustrates a cross-sectional view of a state in which the upper trim and a fixing trim shown in FIG. 3 are coupled to the door body.

Referring to FIGS. 2 and 3, the first door 101 may include a door panel 110 and a door body 120. The door panel 110 may be detachably coupled to the door body 120.

Referring to FIG. 3, the door panel 110 may include a panel body 111, a first side trim 113 fixed to a rear edge of the panel body 111, a second side trim 112, and an upper trim 114 and a lower trim 115. In addition, the door panel 110 may further include a buffer member 116 provided on a rear surface of the panel body 111.

The panel body 111 may form an outer shape of the first door 101. The panel body 111 may have a flat plate shape. Various designs may be provided on a front surface of the panel body 111 to meet user needs. The trims 112, 113, 114, and 115 for coupling with the door body 120 may be arranged on the rear surface of the panel body 111.

The panel body 111 may have a predetermined thickness or more. The panel body 111 shown in FIGS. 9 to 12 may include glass. When the panel body 111 has the predetermined thickness or more, an end portion of the panel body 111 may be finished so as not to be sharp.

The buffer member 116 may be arranged on the rear surface of the panel body 111. The buffer member 116 may be arranged in a space between the door panel 110 and the door body 120. When an impact is applied to the door panel 110, the buffer member 116 may be provided to prevent the impact from being transmitted to the door body 120. In addition, the buffer member 116 may be provided to absorb noise that may be generated from the door panel 110. The buffer member 116 may include expanded polystyrene.

Referring to FIGS. 3 to 7, the door panel 110 may include the first side trim 113, the second side trim 112, the upper trim 114, and the lower trim 115. The trims 112, 113, 114, and 115 may be attached to the panel body 111 through an adhesive 108 (refer to FIGS. 9 to 12). The trims 112, 113, 114, and 115 may be adhered to the panel body 111 using a Poly Urethane Reactive (PUR) adhesive method. However, the fixing method of the trims 112, 113, 114, and 115 is not limited thereto. By the trims 112, 113, 114, and 115, the door panel 110 may be firmly coupled to the door body 120, and coupled so as to be easily separated from each other.

Particularly, referring to FIGS. 4 and 9, the first side trim 113 may include a first side trim body 113*a*, a first side trim protrusion 113*b*, a first side coupling protrusion 113*c*, and a first side trim groove 113*d*. The first side trim 113 may be arranged on an edge of one side of the panel body 111.

According to one embodiment of the present disclosure, the first side trim 113 may be arranged on a right edge with respect to the rear surface of the panel body 111.

The first side trim body 113*a* may extend substantially vertically to be fixed to the right edge of the panel body 111. The first side trim body 113*a* may have a substantially rectangular plate shape. The first side trim body 113*a* may be fixed to the panel body 111 through the adhesive 108.

The first side trim protrusion 113*b* may protrude rearward from the first side trim body 113*a*. The first side trim protrusion 113*b* may protrude rearward from one end of one side of the first side trim body 113*a*. For example, the first side trim protrusion 113*b* may protrude rearward from a right end of the first side trim body 113*a*.

The first side coupling protrusion 113*c* may be formed at a rear end of the first side trim protrusion 113*b*. The first side coupling protrusion 113*c* may have a bent shape to include the first side trim groove 113*d*. The first side trim groove 113*d* may be provided to accommodate a chassis protrusion 132 of a first chassis 130. Hereinafter the chassis protrusion 132 may be referred to as a first support protrusion 132. As the first support protrusion 132 is inserted into the first side trim groove 113*d*, one end of one side of the door panel 110 may be fixed to the door body 120.

Referring to FIGS. 5 and 10, the second side trim 112 may include a second side trim body 112*a*, a second side trim protrusion 112*b*, a second side coupling protrusion 112*c*, a second side trim groove 112*e*, and a second side support protrusion 112*d*. The second side trim 112 may be arranged on an edge of one side of the panel body 111. According to one embodiment of the present disclosure, the panel body 111 may be arranged on a left edge with respect to the rear surface of the panel body 111.

The second side trim body 112*a* may extend substantially vertically to be fixed to the left edge of the panel body 111. The second side trim body 112*a* may have a substantially rectangular plate shape. The second side trim body 112*a* may be fixed to the panel body 111 through the adhesive 108.

The second side trim protrusion 112*b* may protrude rearward from the second side trim body 112*a*. The second side trim protrusion 112*b* may protrude rearward from one end of the second side trim body 112*a*. For example, the second side trim protrusion 112*b* may protrude rearward from the left end.

The second side coupling protrusion 112*c* may be formed at a rear end of the second side trim protrusion 112*b*. The second side coupling protrusion 112*c* may have a bent shape to include the second side trim groove 112*e*. The second side trim groove 112*e* may be provided to include a first sliding protrusion 183 of a sliding trim 180. As the first sliding protrusion 183 of the sliding trim 180 is inserted into the second side trim groove 112*e*, the other end of the door panel 110 may be fixed to the door body 120.

Referring to FIGS. 6 and 11, the lower trim 115 may include a lower trim body 115*a*, a lower trim protrusion 115*b*, a lower trim groove 115*c*, a lower trim segment 115*d*, and a reinforcing protrusion 115*e*. The lower trim 115 may be arranged on a lower edge of the panel body 111.

The lower trim body 115*a* may extend substantially vertically to be fixed to a lower end of the panel body 111. The lower trim body 115*a* may have a substantially rectangular plate shape. The lower trim body 115*a* may be fixed to the panel body 111 through the adhesive 108.

The lower trim protrusion 115*b* may protrude rearward from the lower trim body 115*a*. The lower trim protrusion 115*b* may be provided to form the lower trim groove 115*c* between the lower trim body 115*a* and the lower trim protrusion 115*b*. The lower trim protrusion 115*b* may have a shape extending rearward by a predetermined length from the lower trim body 115*a* and then substantially extending in a vertical direction.

The lower trim groove 115*c* may be formed between the lower trim protrusion 115*b* and the lower trim body 115*a*. The lower trim groove 115*c* may be provided to accommodate a lower cap protrusion 172 of a lower door cap 170. The lower trim groove 115*c* may be provided to correspond to the size and/or shape of the lower cap protrusion 172. As the lower cap protrusion 172 is inserted into the lower trim groove 115*c*, the lower end of the panel body 111 may be fixed to the door body 120.

The lower trim segment 115*d* may be formed on the lower trim protrusion 115*b*. The lower trim segment 115*d* may be provided to divide the lower trim protrusion 115*b* into a plurality of parts. Parts of the lower trim protrusion 115*b* divided by the lower trim segment 115*d* may be spaced apart from each other along the extending direction of the lower trim protrusion 115*b*. In FIG. 6, three lower trim segments 115*d* are illustrated, but the number of lower trim segments 115*d* is not limited thereto. The lower trim segment 115*d* divides the lower trim protrusion 115*b* into a plurality of parts, and thus when the panel body 111 is deformed by heat, it is possible to prevent damage in the lower trim 115 caused by the deformation force applied to the lower trim 115.

The reinforcing protrusion 115*e* may protrude rearward from the lower trim body 115*a*. Unlike the lower trim protrusion 115*b*, the reinforcing protrusion 115*e* may protrude only rearward, and the reinforcing protrusion 115*e* may include a plurality of reinforcing protrusions 115*e* spaced apart from each other. The reinforcing protrusions 115*e* may be provided to reinforce a strength of the lower trim 115. The number of the reinforcing protrusions 115*e* may be three shown in the drawings, but may vary.

Referring to FIGS. 7 and 12, the upper trim 114 may include an upper trim body 114*a*, an upper trim protrusion 114*b*, and a fixing protrusion 114*c*. In addition, the upper trim 114 may further include an upper trim segment 114*e* and an upper trim hole 114*d*. The upper trim 114 may be arranged on an upper edge of the panel body 111.

The upper trim body 114*a* may extend substantially vertically to be fixed to the upper end of the panel body 111. The upper trim body 114*a* may have a substantially rectangular plate shape. The upper trim body 114*a* may be fixed to the panel body 111 through the adhesive 108.

The upper trim protrusion 114*b* may protrude rearward from the upper trim body 114*a*. The upper trim protrusion 114*b* may be provided to be inserted into a coupling space 163 of an upper door cap 160. The upper trim protrusion 115*b* may be fixed in a state of being inserted into the coupling space 163 by a fixing trim 190 to be described later.

Although not shown in the drawing, as a fixing member (not shown) is inserted into the upper trim hole 114*d* by passing through the upper door cap 160, the upper trim protrusion 115*b* may be fixed in a state of being inserted into the coupling space 163.

The upper trim segment 114*e* may be formed on the upper trim protrusion 114*b*. The upper trim segment 114*e* may be provided to divide the upper trim protrusion 114*b* into a plurality of parts. Parts of the upper trim protrusion 114*b* divided by the upper trim segment 114*e* may be spaced apart from each other along the extending direction of the upper trim protrusion 114*b*. In FIG. 7, one upper trim segment 114*e* is illustrated, but the number of upper trim segments 114*e* is not limited thereto. The upper trim segment 114*e* divides the upper trim protrusion 114*b* into a plurality of parts, and thus when the panel body 111 is deformed by heat, it is possible to prevent damage in the upper trim 114 caused by the deformation force applied to the upper trim 114.

Referring to FIGS. 3 and 8, the door body 120 may include the chassis 130 and 140, the upper door cap 160, the lower door cap 170, a cover 150, and a case 121.

The chassis 130 and 140 may include materials different from those of the upper door cap 160 and the lower door cap 170. Particularly, the chassis 130 and 140 may include a metal material such as aluminum. The upper door cap 160 and the lower door cap 170 may include acrylonitrile butadiene styrene copolymer (ABS resin).

The chassis 130 and 140 may include the first chassis 130 forming the left side of the first door 101 and a second chassis 140 forming the right side of the first door 101. The chassis 130 and 140 may extend in the vertical direction.

The cover 150 may be provided to cover the front of the case 121 by being coupled to the front of the case 121. The cover 150 may form the front surface of the door body 120. Although FIG. 8 illustrates that the cover 150 and the chassis 130 and 140 are separated, embodiments of this disclosure are not limited thereto. Unlike the drawings, the cover 150 and the chassis 130 and 140 may be integrally formed with each other. That is, the cover 150 and the chassis 130 and 140 may be provided as one body.

Referring to 8 and 9, the first chassis 130 may include a first chassis body 131, the first support protrusion 132, a first chassis extension 133, a second support protrusion 134 and a first chassis groove 135.

The first chassis body 131 may form the left side of the first door 101 and may have a substantially rectangular plate shape. The first chassis body 131 may have a substantially rectangular plate shape with long sides arranged in the vertical direction.

The first support protrusion 132 may be formed to extend laterally from the first chassis body 131. The first support protrusion 132 may be provided to be inserted into the first side trim groove 113*d* of the first side trim 113 described above. The first support protrusion 132 may be inserted into the first side trim groove 113*d* to fix the first side trim 113, thereby preventing the first side trim 113 from moving forward.

The first support protrusion 132 may include at least one bending member. An end of the first support protrusion 132 may be bent rearward. By including the bending member, the first support protrusion 132 may more firmly fix the first side trim 113. That is, even when the first side trim 113 is pulled forward, the first support protrusion 132 may not fall out of the first side trim groove 113*d*, and the first side trim 113 may not be separated from the first chassis 130.

The first chassis extension 133 may be spaced apart from the first support protrusion 132 by a predetermined distance. In the same manner as the first support protrusion 132, the first chassis extension 133 may be formed to extend laterally from the first chassis body 131. An end of the first chassis extension 133 may be bent, and an end of the cover 150 may be coupled to the bending member. An insulator 122 may be arranged in a space formed by the first chassis extension 133, the cover 150, and the first chassis body 131.

The second support protrusion 134 may protrude from the first chassis extension 133. Particularly, the second support protrusion 134 may protrude forward from the first chassis extension 133. At least a portion of the second support protrusion 134 may have a shape bending toward the first support protrusion 132.

The first chassis groove 135 may be formed between the first support protrusion 132 and the second support protrusion 134. The first side coupling protrusion 113*c* of the first side trim 113 may pass through the first chassis groove 135 and insert the first support protrusion 132 into the first side trim groove 113*d*.

In order to allow the support protrusion 134 to be deformed by being pressed by the first side coupling protrusion 113*c*, and to be restored when the second support protrusion 134 is coupled to the first side coupling protrusion 113*c*, the support protrusion 134 may be formed to include a material having predetermined elasticity.

Referring to FIGS. 8 and 10, the second chassis 140 may include a second chassis body 141, a third support protrusion 142, a cover groove 143, and a second chassis extension 144, a fourth support protrusion 145, and a second chassis groove 146.

The second chassis body 141 may form the right side of the first door 101 and may have a substantially rectangular plate shape. The second chassis body 141 may have a substantially rectangular plate shape with long sides arranged in the vertical direction.

The third support protrusion 142 may be formed to extend laterally from the second chassis body 141. The third support protrusion 142 may be provided to support the sliding trim 180. An end of the third support protrusion 142 may be bent to increase a contact area of the sliding trim 180. Particularly, the end of the third support protrusion 142 may be bent rearward.

The cover groove 143 may be provided between the third support protrusion 142 and the second chassis body 141. The cover protrusion 185 of the sliding trim 180 may be inserted into the cover groove 143.

The second chassis extension 144 may be spaced apart from the third support protrusion 142 by a predetermined distance. In the same manner as the third support protrusion 142, the second chassis extension 144 may be formed to extend laterally from the second chassis body 141. An end of the second chassis extension 144 may be bent, and an end of the cover 150 may be coupled to the bending member. The insulator 122 may be arranged in a space formed by the second chassis extension 144, the cover 150, and the second chassis body 141.

The fourth support protrusion 145 may protrude from the second chassis extension 144. Particularly, the fourth support protrusion 145 may protrude forward from the second chassis extension 144. At least a portion of the fourth support protrusion 145 may have a shape bending toward the third support protrusion 142.

The second chassis groove 146 may be formed between the third support protrusion 142 and the second support protrusion 145. The second chassis groove 146 may be larger than the first chassis groove 135. The second side trim 113 and the sliding trim 180 may be arranged in the second chassis groove 146.

Referring to FIGS. 8 and 11, the lower door cap 170 may be coupled to lower ends of the chassis 130 and 140. The lower door cap 170 may form the lower surface of the first door 101.

The lower door cap 170 may include a lower cap body 171, the lower cap protrusion 172 protruding upward from the lower cap body 171, and an installation guide 174 spaced apart from the lower cap protrusion 172 and protruding higher than the lower cap protrusion 172. In addition, the lower door cap 170 may further include a lower trim support protrusion 173 protruding forward from the lower cap protrusion 172 and a lower cap cover 176 covering a front end 175 of the lower cap body 171. The lower cap cover 176 may include a receiving groove 177 provided to receive the front end 175 of the lower cap body.

The lower cap body 171 may form the lower surface of the first door 101. The lower cap cover 176 may be coupled to the front end 175 of the lower cap body 171. The lower cap cover 176 may form an exterior of the lower edge of the first door 101 and support the door panel 110.

The lower cap protrusion 172 may be formed on the lower cap body 171. The lower cap protrusion 172 may protrude upward from a bottom surface of the lower cap body 171. The lower cap protrusion 172 may be inserted into the lower trim groove 115*c* of the lower trim 115. The lower cap protrusion 172 may further include the lower trim support protrusion 173. The lower trim support protrusion 173 may protrude forward from the lower cap protrusion 172 to limit a distance of a downward movement of the lower trim 115. The lower trim support protrusion 173 may support the lower trim 115.

The lower door cap 170 may include the installation guide 174 protruding upward from the lower cap body 171. The installation guide 174 may be spaced apart from the lower cap protrusion 172 by a predetermined distance. The installation guide 174 may be provided to guide the lower trim 115 of the door panel 110 to an installation position when the door panel 110 is mounted on the door body 120.

A lower cap hole 170*a* may be formed in the lower door cap 170. The lower cap hole 170*a* may be formed to allow a fastening member (not shown) for coupling with the cover 150, to be coupled thereto. After aligning the cover 150 with respect to the lower door cap 170 to allow the cover hole 152 to be located at a position corresponding to the lower cap hole 170*a*, the fastening member may be inserted into the cover hole 152 and the lower cap hole 170*a*, thereby fixing the cover 150 to the lower door cap 170.

Referring to FIGS. 8 and 12, the upper door cap 160 may include an upper cap body 161 and a coupling space 163.

The upper cap body 161 may form the upper surface of the first door 101. The fixing trim 190 may be coupled to a front end 162 of the upper cap body 161. Particularly, the front end 162 of the upper cap body 161 may be inserted into a first fixing groove 191 of the fixing trim 190.

The coupling space 163 may receive the upper trim 114. Particularly, the coupling space 163 may receive the upper trim protrusion 114*b* of the upper trim 114 therein.

Referring to FIGS. 8 and 10, the first door 101 may include the sliding trim 180.

The sliding trim 180 may be slidably inserted between the second side trim 112 and the second chassis 140 to fix the door panel 110 to the door body 120.

According to the present disclosure, the first door 101 may include the sliding trim 180 forming the exterior of one side end of the first door 101. The sliding trim 180 may be provided to cover a separation space S2 formed between one side end of the door panel 110 and one side end of the door body 120. The sliding trim 180 not only fixes the door panel 110 to the door body 120, but also forms a part of the exterior of the first door 101 to improve aesthetics of the first door 101.

The sliding trim 180 may include a sliding body 181 provided to be inserted into a sliding groove S1 formed between the second side trim 114 and the second chassis 140, a cover member 182 extending from the sliding body 181, the first sliding protrusion 183, and a second sliding protrusion 184.

The sliding body 181 may be arranged parallel to the second chassis body 141 of the second chassis 140, and may have a substantially rectangular plate shape. The sliding body 181 may slide in the vertical direction and then be inserted into the sliding groove S1.

The cover member 182 may be formed to extend from a front end of the sliding body 181. The cover member 182 may be located at the above-described separation space S2 to cover the separation space S2 to prevent the separation space S2 from being exposed to the outside. The cover member 182 may include a cover protrusion 185 provided to be inserted into the cover groove 143 of the second chassis 140. The cover protrusion 185 may protrude rearward from the cover member 182.

The first sliding protrusion 183 may protrude laterally from the sliding body 181. Particularly, the first sliding protrusion 183 may protrude from the sliding body 181 to the left side with respect to FIG. 10. The first sliding protrusion 183 may be inserted into the second side trim groove 112*e* of the second side trim 112. As the first sliding protrusion 183 is inserted into the second side trim groove 112*e*, the movement of the second side trim 112 may be limited. That is, the second side trim 112 may be fixed.

The second sliding protrusion 184 may be formed to extend laterally from the rear end of the sliding body 181. Particularly, the second sliding protrusion 184 may protrude from the rear end of the sliding body 181 to the right side with respect to FIG. 10. The second sliding protrusion 184 may be provided to be in contact with the second chassis body 141 and the third support protrusion 142. An end of the second sliding protrusion 184 may be bent, and a portion of the bending member may be provided to be in contact with the second chassis body 141. The remaining portion of the bending member may be provided to be in contact with the third support protrusion 142. In addition to the above structure, the third support protrusion 142 is arranged in front of the second sliding protrusion 184, and thus the sliding trim 180 is limited from moving forward of the second chassis 140. That is, the sliding trim 180 may be fixed to the second chassis 140.

Referring to FIGS. 8 and 12, the first door 101 may include the fixing trim 190. The fixing trim 190 may fix the upper trim 114 to the upper door cap 160 by being coupled to the upper trim 114 and the upper door cap 160.

The fixing trim 190 may be inserted into a separation space S3 to cover the separation space S3 between the upper end of the door panel 110 and the front end of the upper door cap 160. The fixing trim 190 may include the first fixing groove 191, to which the front end 162 of the upper cap body 161 is inserted, and a second fixing groove 192 to which the fixing protrusion 114*c* of the upper trim 114 is inserted.

As the front end 162 of the upper cap body 161 is inserted into the first fixing groove 191, and the fixing protrusion 114*c* of the upper trim 114 is inserted into the second fixing groove 192, the upper cap body 160 and the upper trim 114 may be fixed to the fixing trim 190, respectively. The upper end of the door panel 110 may be fixed to the door body 120 as the upper cap body 160 and the upper trim 114 are fixed to the fixing trim 190.

Figure 13:
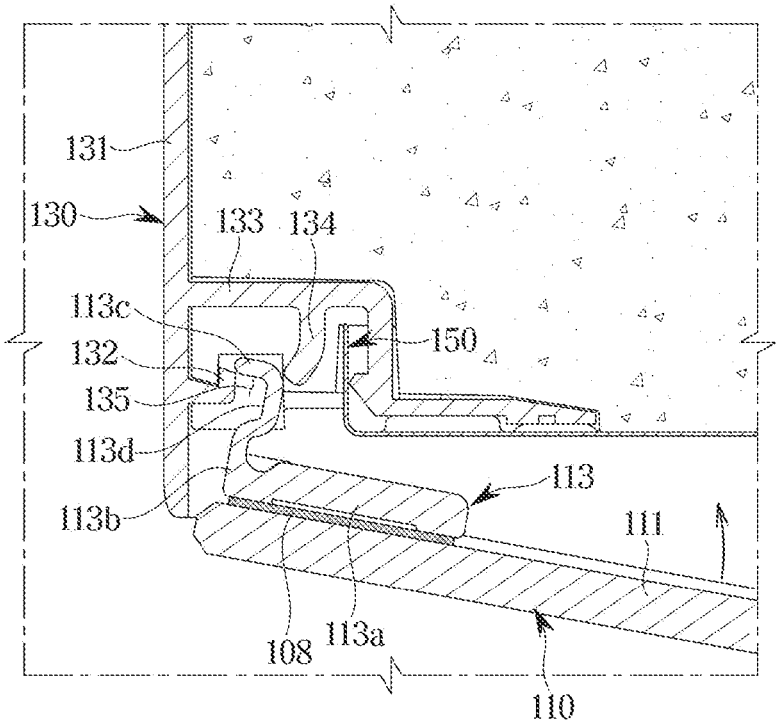
FIG. 13 illustrates a state in which the first side trim shown in FIG. 9 is coupled to the door body.
Figure 14:
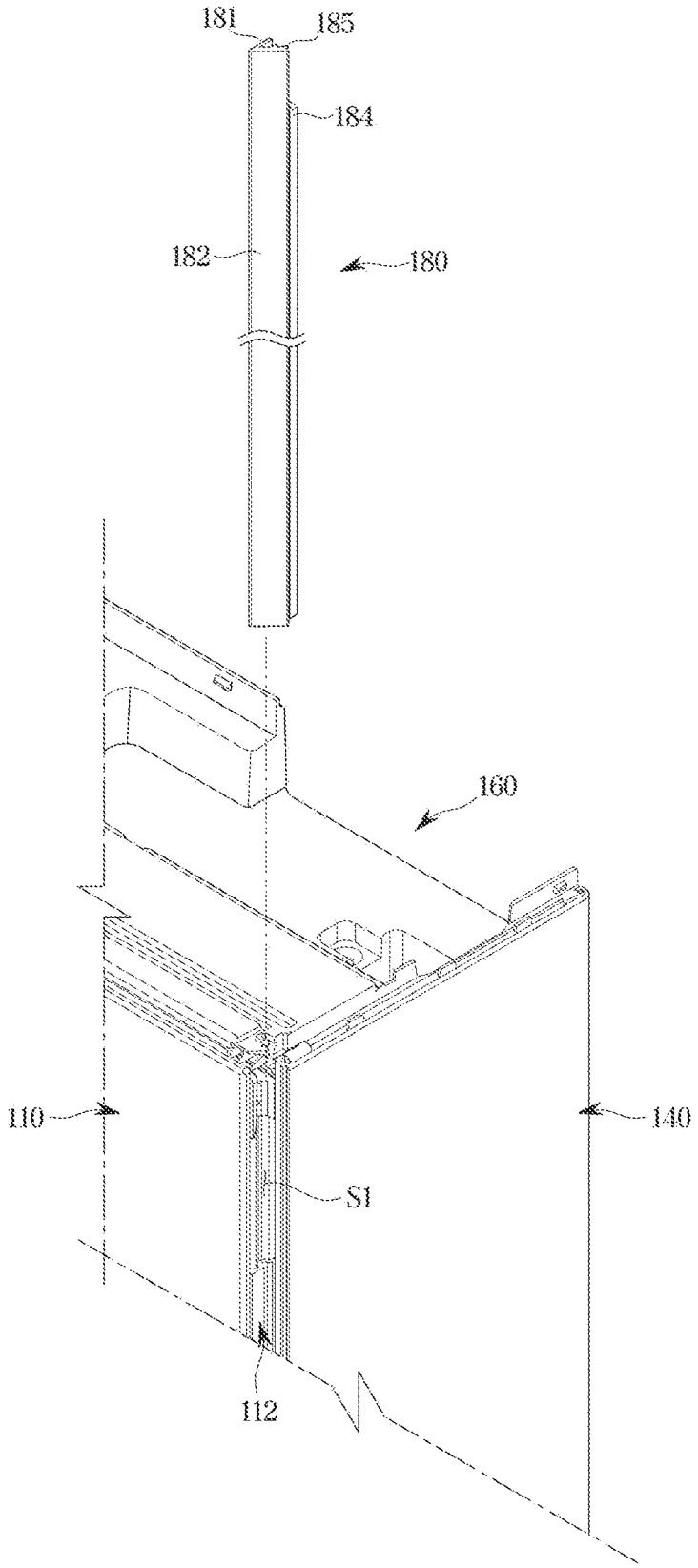
FIG. 14 illustrates a state in which the sliding trim shown in FIG. 10 is coupled to the door panel and the door body.
Figure 15:
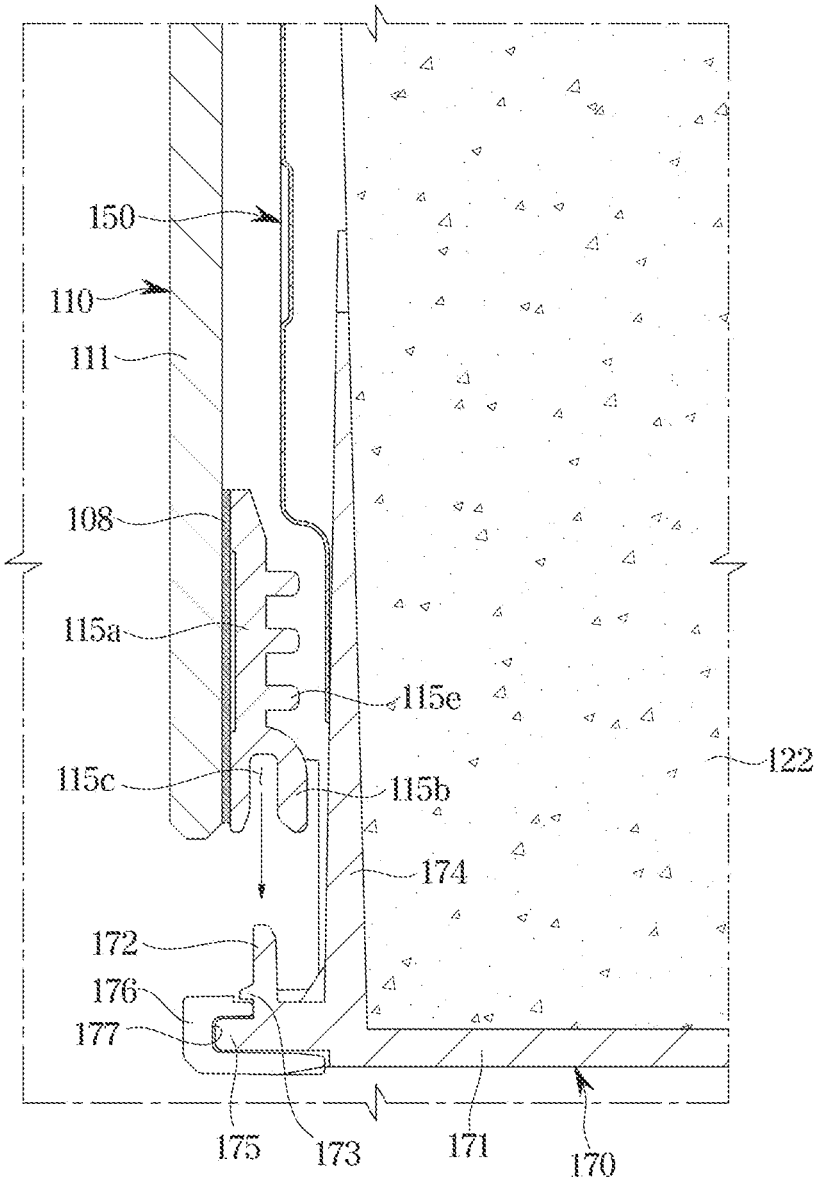
FIG. 15 illustrates a state in which the lower trim shown in FIG. 11 is coupled to the door body.
Figure 16:
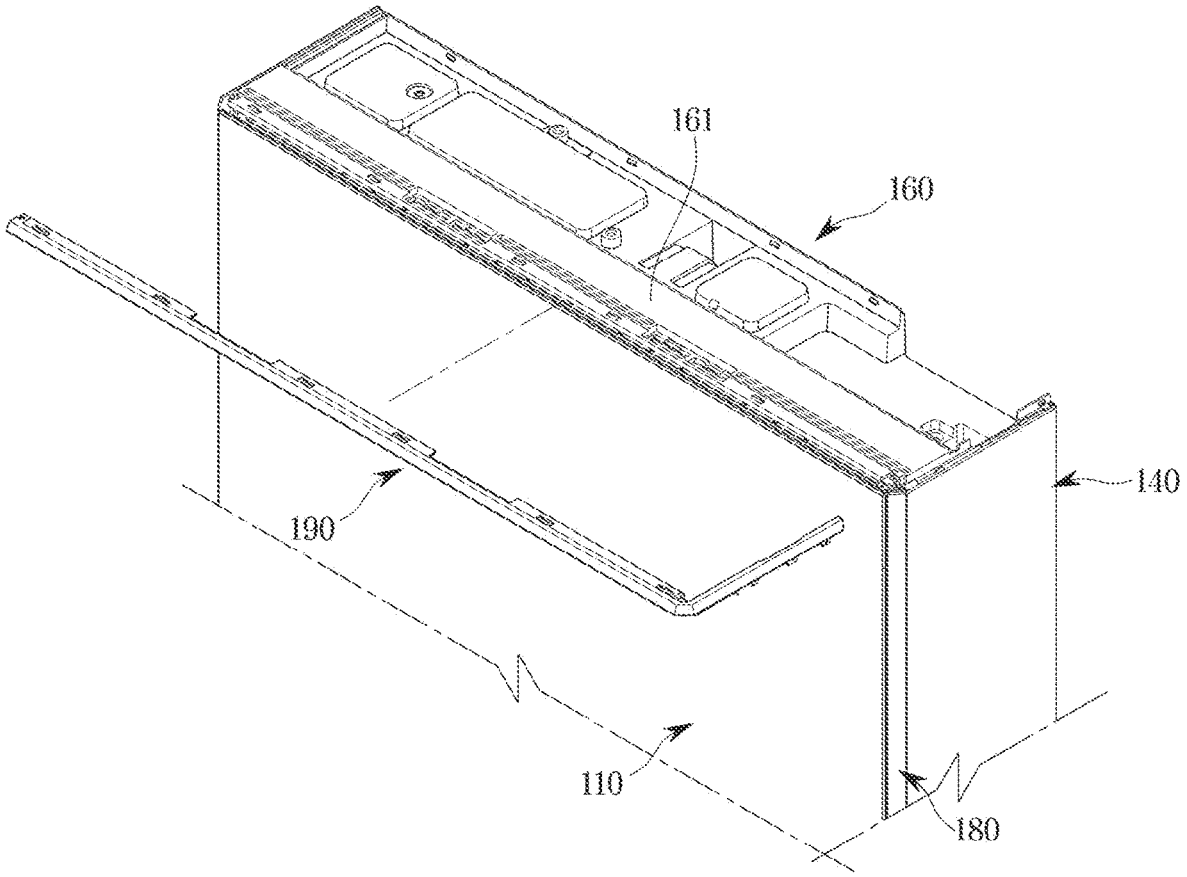
FIG. 16 illustrates a state in which the fixing trim shown in FIG. 12 is coupled.

FIG. 13 illustrates a state in which the first side trim shown in FIG. 9 is coupled to the door body. FIG. 14 illustrates a state in which the sliding trim shown in FIG. 10 is coupled to the door panel and the door body. FIG. 15 illustrates a state in which the lower trim shown in FIG. 11 is coupled to the door body. FIG. 16 illustrates a state in which the fixing trim shown in FIG. 12 is coupled.

A process of coupling the door panel 110 to the door body 120 will be described with reference to FIGS. 13 to 16.

Referring to FIG. 13, the door panel 110 is aligned to allow the left end of the door panel 110 to be adjacent to the front end of the first chassis 130. The door panel 110 is obliquely aligned to allow the right end of the door panel 110 to be spaced apart from the second chassis 140. The first side coupling protrusion 113*c* of the first side trim 113 may be located outside the first chassis groove 135 of the first chassis 130.

After the door panel 110 is aligned as described above, the door panel 110 is rotated to allow the first side coupling protrusion 113*c* to pass through the first chassis groove 135 and to allow the first support protrusion 132 to be inserted into the first side trim groove 113*d*. The door panel 110 may be rotated with the left end of the door panel 110 as a rotation center. When the door panel 110 is rotated, the first support protrusion 132 may be inserted into the first side trim groove 113*d*, and the left end of the door panel 110 may be fixed to the door body 120, as shown in FIG. 9.

Referring to FIGS. 14 and 15, even when the left end of the door panel 110 is fixed to the door body 120, the right end, the lower end and the upper end of the door panel 110 may not be fixed to the door body 120.

Before the right end of the door panel 110 is fixed to the door body 120 by coupling the sliding trim 180, the door panel 110 may be moved downward. Referring to FIG. 15, even when the left end of the door panel 110 is fixed to the door body 120, the door panel 110 may be moved upward or downward within a predetermined range. When the left end of the door panel 110 is fixed to the door body 120 through the above process, the door panel 110 may be rotated while the door panel 110 is slightly lifted. When the door panel 110 is rotated in the lifted state, the door panel 110 may be aligned to allow the lower cap protrusion 172 to be positioned under the lower trim groove 115*c* as shown in FIG. 15. When the door panel 110 is moved downward to allow the lower cap protrusion 172 to be inserted into the lower trim groove 115*c*, the lower end of the door panel 110 may be fixed to the door body 120 as shown in FIG. 11.

Through the above process, the left end of the door panel 110 and the lower end of the door panel 110 may be fixed to the door body 120.

In order to fix the right end of the door panel 110 to the door body 120, the sliding trim 180 may be slidably coupled to the door panel 110 and the door body 120.

Referring to FIG. 14, the sliding trim 180 may be coupled to the first door 101 by moving the sliding trim 180 from the upper side of the first door 101 to the lower side. As the sliding trim 180 is moved downward, the first sliding protrusion 183 may be slidably coupled to the second side trim groove 112*e*, the sliding body 181 may be slidably coupled to the sliding groove S1, and the cover protrusion 185 may be slidably coupled to the cover groove 143.

When the sliding trim 180 is slidably coupled to the first door 101, the right end of the door panel 110 may be fixed to the door body 120.

Even through the above process, the upper end of the door panel 110 may not be fixed to the door body 120.

Referring to FIGS. 12 and 16, by inserting the fixing trim 190 into the separation space S3 between the upper end of the door panel 110 and the front end of the upper door cap 160, the upper end of the door panel 110 may be fixed to the door body 120. When the fixing trim 190 is inserted into the separation space S3, the front end 162 of the upper cap body 161 may be inserted into the first fixing groove 191, and the fixing protrusion 114*c* of the upper trim 114 may be inserted into the second fixing groove 192.

Through the above-described process, the left end, the right end, and the upper and lower end of the door panel 110 may be fixed to the door body 120, respectively.

As the above process is performed in reverse, the door panel 110 may be separated from the door body 120.

Figure 17:
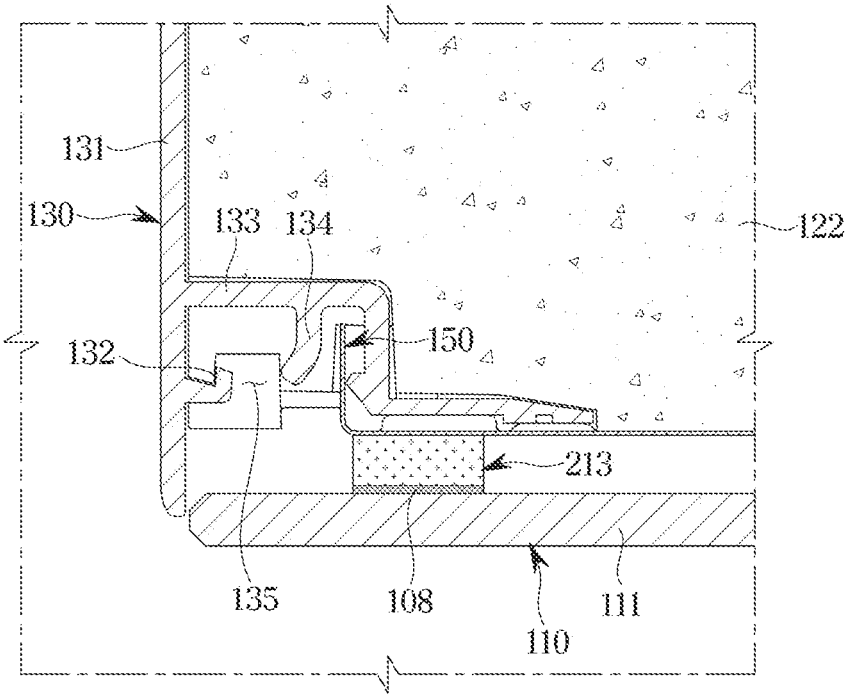
FIG. 17 illustrates a cross-sectional view of a state in which a first side trim according to another embodiment of the present disclosure is coupled to a door body.

FIG. 17 illustrates a cross-sectional view of a state in which a first side trim according to another embodiment of the present disclosure is coupled to a door body.

A door panel according to another embodiment of the present disclosure will be described with reference to FIG. 17. However, the same reference numerals are assigned to components the same as those of the previously described embodiment, and detailed descriptions thereof may be omitted.

Referring to FIG. 17, a door panel 110 according to another embodiment of the present disclosure may include a first side trim 213 different from the first side trim 113 shown in FIGS. 3 to 16. In comparison with the door panel 110 shown in FIGS. 3 to 16, other components except for the first side trim 213 may be provided in the same manner.

According to another embodiment of the present disclosure, the first side trim 213 may include a magnetic material. The first side trim 213 may be provided to generate an attractive force with the cover 150 when the left end of the door panel 110 is coupled to the door body 120. The cover 150 may include steel. The first side trim 213 may be in contact and be fixed to the cover 150 by a magnetic force between the first side trim 213 and the cover 150. Accordingly, the left end of the door panel 110 may come into close contact with the door body 120 and be stably fixed.

Figure 18:
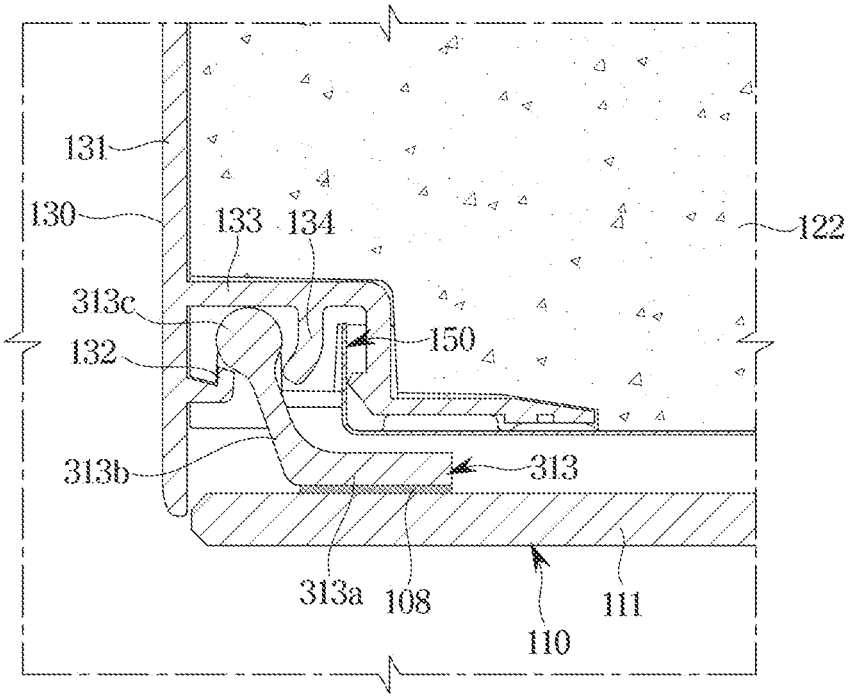
FIG. 18 illustrates a cross-sectional view of a state in which a first side trim according to still another embodiment of the present disclosure is coupled to a door body.

FIG. 18 illustrates a cross-sectional view of a state in which a first side trim according to still another embodiment of the present disclosure is coupled to a door body.

A first side trim 313 according to still another embodiment of the present disclosure will be described with reference to FIG. 18. However, the same reference numerals are assigned to components the same as those of the previously described embodiment, and detailed descriptions thereof may be omitted.

Referring to FIG. 18, the side trim 313 according to still another embodiment of the present disclosure may include a trim body 313*a* fixed to the door panel 110, a trim protrusion 313*b* extending in an oblique direction from the trim body 313*a*, and a trim insert 313*c* arranged at an end of the trim protrusion 313*b* and having a larger width than the trim protrusion 313*b*.

The trim body 313*a* may be provided in a substantially rectangular plate shape and fixed to the rear surface of the door panel 110 by the adhesive 108. The trim protrusion 313*b* may extend rearward from one end of the trim body 313*a* and may extend in an oblique direction. Particularly, the trim protrusion 313*b* may extend from the left end of the trim body 313*a* toward the rear left side.

The trim insert 313*c* may be provided at an end of the trim protrusion 313*b* and may have a larger width than the trim protrusion 313*b*. A cross-section of the trim insert 313*c* may have a substantially circular shape. The width may refer to a length in a direction crossing the extending direction of the trim protrusion 313*b*. Accordingly, when the cross-sectional shape of the trim insert 313*c* is a circle, the width of the trim insert 313*c* may indicate a diameter of a circle.

Referring to FIG. 18, the trim insert 313*c* may be inserted into the first chassis groove 135 (refer to FIG. 9). In order to insert the trim insert 313*c* into the first chassis groove 135, the door panel 110 rotates or moves to an oblique direction as described above due to the large width of the trim insert 313*c*. When the trim insert 313*c* is inserted into the first chassis groove 135, the trim insert 313*c* may not fall out of the first chassis groove 135 even when the trim insert 313*c* is pulled forward. That is, the left end of the door panel 110 may be fixed to the door body 120 by inserting the trim insert 313*c* into the first chassis groove 135.

Figure 19:
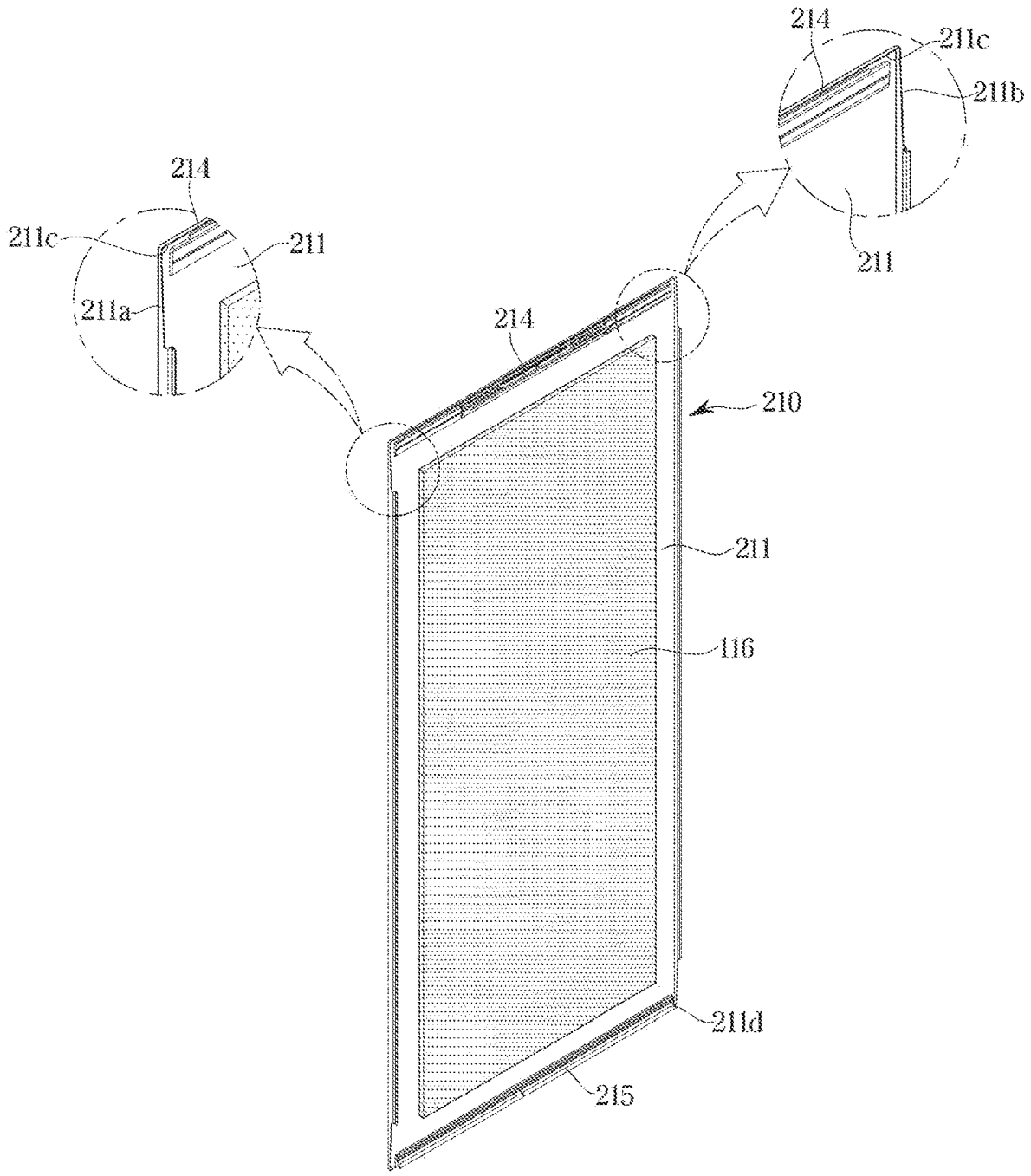
FIG. 19 is a view illustrating a rear surface of a door panel according to still another embodiment of the present disclosure.
Figure 20:
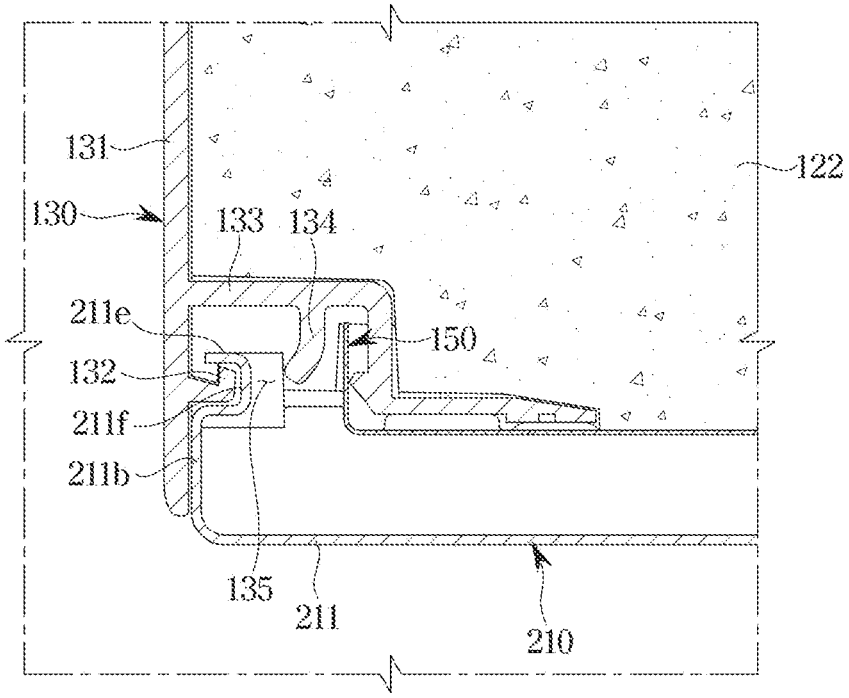
FIG. 20 illustrates a cross-sectional view of a state in which a first side trim of the door panel shown in FIG. 19 is coupled to the door body.
Figure 21:
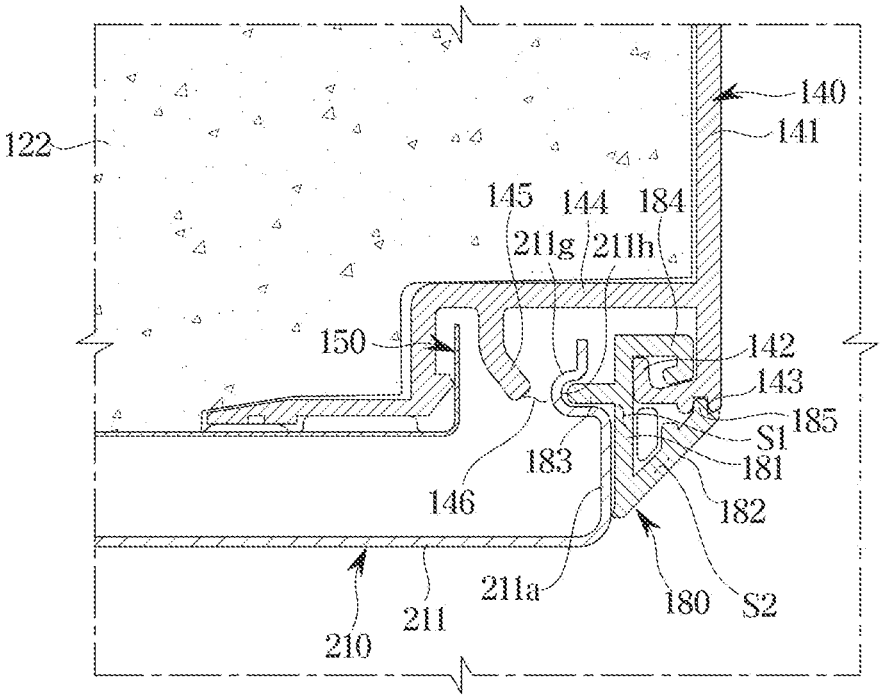
FIG. 21 illustrates a cross-sectional view of a state in which a second side trim of the door panel shown in FIG. 19 is coupled to the door body.
Figure 22:
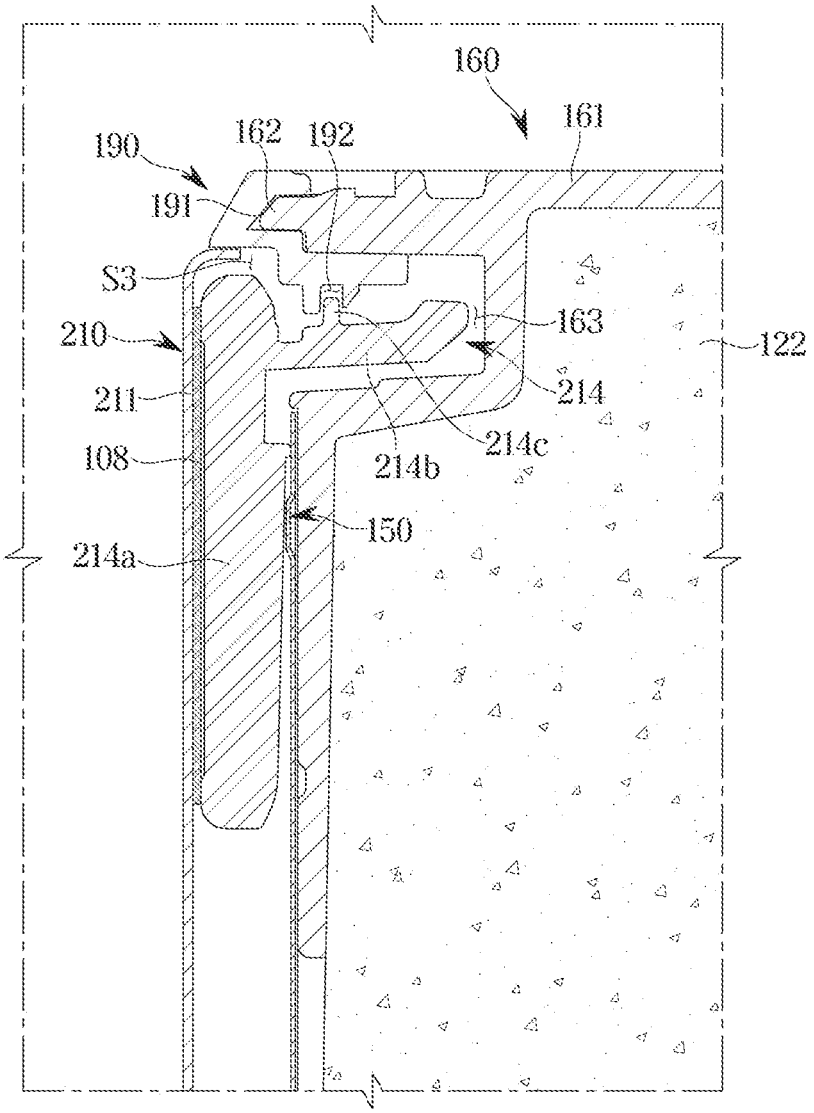
FIG. 22 illustrates a cross-sectional view of a state in which a lower trim of the door panel shown in FIG. 19 is coupled to the door body.
Figure 23:
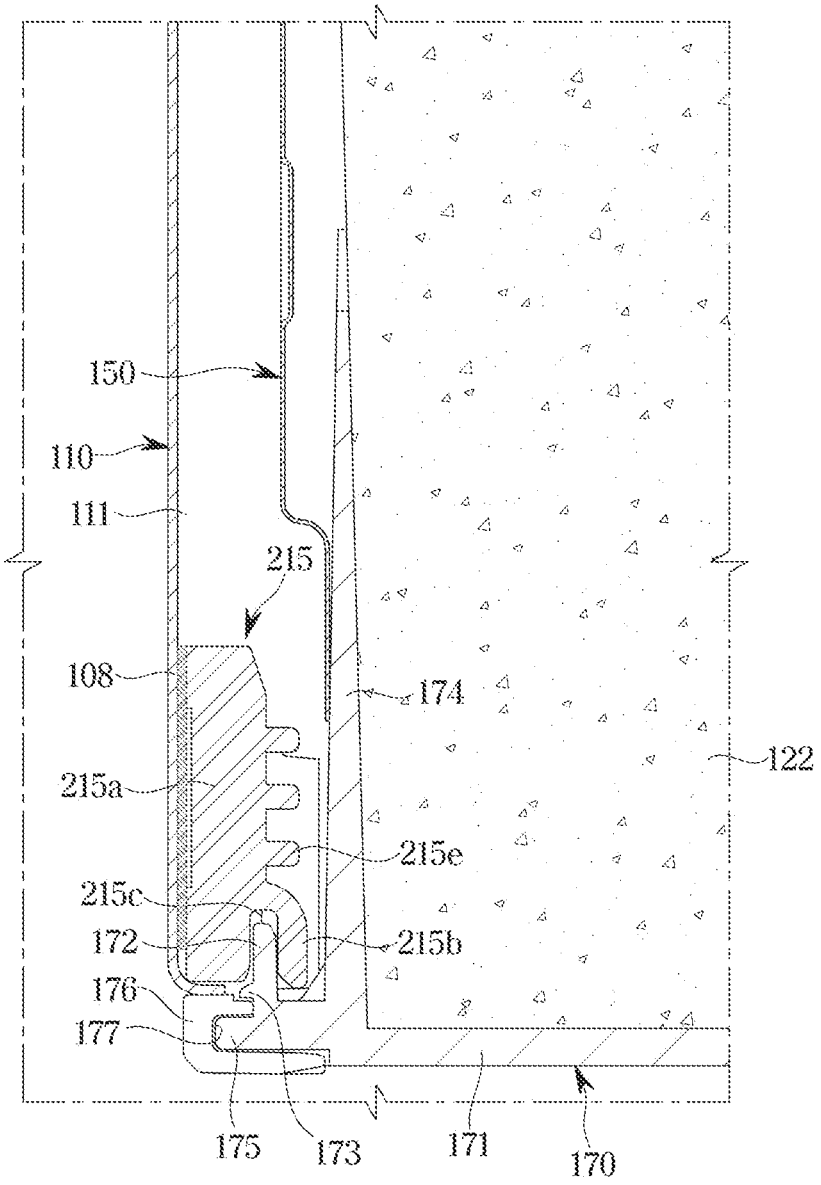
FIG. 23 illustrates a cross-sectional view of a state in which an upper trim of the door panel shown in FIG. 19 is coupled to the door body.

FIG. 19 illustrates a rear surface of a door panel according to still another embodiment of the present disclosure. FIG. 20 illustrates a cross-sectional view of a state in which a first side trim of the door panel shown in FIG. 19 is coupled to the door body. FIG. 21 illustrates a cross-sectional view of a state in which a second side trim of the door panel shown in FIG. 19 is coupled to the door body. FIG. 22 illustrates a cross-sectional view of a state in which a lower trim of the door panel shown in FIG. 19 is coupled to the door body. FIG. 23 illustrates a cross-sectional view of a state in which an upper trim of the door panel shown in FIG. 19 is coupled to the door body.

A door panel 210 according to still another embodiment of the present disclosure will be described with reference to FIGS. 19 to 23. However, the same reference numerals are assigned to components the same as those of the previously described embodiment, and detailed descriptions thereof may be omitted.

Referring to FIG. 19, the door panel 210 according to still another embodiment of the present disclosure may include a panel body 211, a buffer member 116, a first side trim 211*e*, and a second side trim 211*g*, an upper trim 214, and a lower trim 215. In comparison between the door panel 110 shown in FIGS. 3 to 16 and the door panel 210 according to still another embodiment of the present disclosure, the panel body 211 and side trims 211*e* and 211*g* may be different and other components may be the same.

Unlike the panel body 111 composed of glass, as shown in FIGS. 3 to 16, the panel body 211 of the door panel 210 according to still another embodiment of the present disclosure may be formed of a relatively thin steel plate. In this case, in comparison with the panel body 111 shown in FIGS. 3 to 16, it may not be easy to finish the end of the panel body 211 so as not to be sharp.

Referring to FIGS. 19 to 23, the end of the panel body 211 may be bent toward a direction of being coupled to the door body 120. The bent ends of the panel body 211 may be referred to as panel bending members 211*a*, 211*b*, 211*c*, and 211*d*.

Particularly, referring to FIG. 19, an end of the first panel bending member 211*a* at the left end of the panel body 211 may be additionally bent to form the first side trim 211*e*. An end of the second panel bending member 211*b* at the right end of the panel body 211 may be additionally bent to form the second side trim 211*g*.

In addition, the third panel bending member 211*c* at the upper end of the panel body 211 may be bent to be positioned above the upper trim 214. The third panel bending member 211*c* at the upper end of the panel body 211 may be positioned between the upper trim 214 and the front end of the fixing trim 190.

In addition, the fourth panel bending member 211*d* at the lower end of the panel body 211 may be bent to be positioned below the lower trim 215. The fourth panel bending member 211*d* at the lower end of the panel body 211 may be positioned between the lower trim 215 and the front end of the lower cap body 170. Particularly, the fourth panel bending member 211*d* may be positioned between the lower cap cover 176 and the lower trim 215. However, the lower cap cover 176 may not be provided separately, but may be integrally provided with the lower cap body 170 to form the front end of the lower cap body 170.

Referring to FIG. 20, the first panel bending member 211*b* may be arranged to be in contact with the inner surface of the first chassis body 131. The first side trim 211*e* formed by bending the first panel bending member 211*b* may be provided at an end of the first panel bending member 211*b*. The first side trim 211*e* may include a first side trim groove 211*f*. The first side trim groove 211*f* may be provided to accommodate the first support protrusion 132.

Referring to FIG. 21, the second panel bending member 211*a* may be arranged to be in contact with the sliding body 181. The second side trim 211*g* formed by bending the second panel bending member 211*a* may be provided at an end of the second panel bending member 211*a*. The second side trim 211*g* may include a second side trim groove 211*h*. The second side trim groove 211*h* may be provided to accommodate the first sliding protrusion 183. The right end of the door panel 210 may be fixed to the door body 120 by inserting the first sliding protrusion 183 into the second side trim groove 211*h*.

While the present disclosure has been particularly described with reference to exemplary embodiments, it should be understood by those of skilled in the art that various changes in form and details may be made without departing from the spirit and scope of the present disclosure.

one skilled in the art. It is intended that the present disclosure encompass such changes and modifications as fall within the scope of the appended claims.

What is claimed is:

1. A refrigerator, comprising:

a main body provided to form a storage compartment; and a door configured to open and close the storage compartment, wherein the door comprises:

a door body comprising a first chassis and a second chassis that form opposite side surfaces;

a door panel detachably mounted on the door body, and comprising a first side trim provided at a rear surface of the door panel and extending vertically and configured to be coupled to the first chassis by rotating with respect to the first chassis; and a second side trim extending vertically and spaced apart from the second chassis by a predetermined distance to form a sliding groove; and a sliding trim inserted into the sliding groove by sliding with respect to the door body and the door panel, and provided to fix the second side trim to the door body.

2. The refrigerator of claim 1, wherein:

the sliding trim is inserted into the sliding groove to cover a separation space between the second side trim and the second chassis to prevent the separation space from being exposed to an outside.

3. The refrigerator of claim 2, wherein the sliding trim comprises:

a sliding body inserted into the sliding groove;

a cover member extending from the sliding body to cover the separation space;

a first sliding protrusion extending from the sliding body to couple to the second side trim; and a second sliding protrusion extending from the sliding body to couple to the second chassis.

4. The refrigerator of claim 3, wherein:

the sliding body is parallel to one of the side surfaces of the door body formed by the second chassis;

the first sliding protrusion extends from the sliding body in a first direction; and the second sliding protrusion extends from the sliding body in a second direction opposite to the first direction.

5. The refrigerator of claim 4, wherein:
the sliding trim further comprises a cover protrusion protruding from a rear surface of the cover member to couple to the second chassis.

6. The refrigerator of claim 5, wherein:
the second chassis comprises:
a support protrusion configured to support the sliding body and the second sliding protrusion; and
a first groove into which the cover protrusion is inserted; and
the second side trim comprises a second groove into which the first sliding protrusion is inserted.

7. The refrigerator of claim 1, wherein:
the first side trim comprises:
a trim body fixed to the door panel;
a trim protrusion extending from the trim body to a rear side of the door panel; and
a trim groove formed by laterally recessing a portion of the trim protrusion; and
the first chassis comprises a chassis protrusion inserted into the trim groove to support the first side trim.

8. The refrigerator of claim 7, wherein:
the first side trim is configured to rotate with respect to the first chassis to allow the chassis protrusion to be inserted into the trim groove.

9. The refrigerator of claim 1, wherein:
the door panel further comprises an upper trim arranged on an upper edge of a rear surface; and a lower trim arranged on a lower edge of the rear surface; and
the door body further comprises:
an upper door cap coupled to the upper trim; and
a lower door cap coupled to the lower trim.

10. The refrigerator of claim 9, wherein:
the lower trim comprises a lower trim groove;
the lower door cap comprises a lower cap protrusion inserted into the lower trim groove, and provided to support the lower trim to limit a forward and backward movement of the lower trim in response to the lower cap protrusion being inserted into the lower trim groove; and
the lower cap protrusion is inserted into the lower trim groove as the door panel is moved downward with respect to the door body in a state in which the door panel is in close contact with the door body.

11. The refrigerator of claim 9, wherein:
the upper trim comprises an upper trim protrusion;
when the door panel is mounted on the door body, a separation space is formed between an upper end of the door panel and the upper door cap; and
the refrigerator further comprises a fixing trim inserted into the separation space and comprising a fixing groove into which the upper trim protrusion is inserted, the fixing trim configured to fix the upper end of the door panel to the door body in response to the upper trim protrusion being inserted into the fixing groove.

12. The refrigerator of claim 1, wherein:
the door body further comprises a cover that forms a front surface of the door body; and
the first side trim comprises a magnetic material to couple to the cover by a magnetic force.

13. The refrigerator of claim 1, wherein:
the first side trim comprises:
a trim body fixed to the door panel;
a trim protrusion extending from the trim body to a rear side of the door panel; and
a trim insert provided at an end of the trim protrusion and including a larger width than the trim protrusion; and
the first chassis comprises an insert groove into which the trim insert is inserted.

14. The refrigerator of claim 1, wherein the door panel comprises:
a panel body formed of a metal material;
a first panel bending member formed by bending one side end of the panel body backward; and
a second panel bending member formed by bending another side end of the panel body backward.

15. The refrigerator of claim 14, wherein:
the first side trim is formed by bending an end of the first panel bending member; and
the second side trim is formed by bending an end of the second panel bending member.

16. A door for a refrigerator, the door comprising:
a door body comprising a first chassis and a second chassis that form opposite side surfaces;
a door panel detachably mounted on the door body, and comprising a first side trim provided at a rear surface of the door panel and extending vertically and configured to be coupled to the first chassis by rotating with respect to the first chassis; and a second side trim extending vertically and spaced apart from the second chassis by a predetermined distance to form a sliding groove; and
a sliding trim inserted into the sliding groove by sliding with respect to the door body and the door panel, and provided to fix the second side trim to the door body.

17. The door of claim 16, wherein the sliding trim is inserted into the sliding groove to cover a separation space between the second side trim and the second chassis to prevent the separation space from being exposed to an outside.

18. The door of claim 17, wherein the sliding trim comprises:
a sliding body inserted into the sliding groove;
a cover member extending from the sliding body to cover the separation space;
a first sliding protrusion extending from the sliding body to couple to the second side trim; and
a second sliding protrusion extending from the sliding body to couple to the second chassis.

19. The door of claim 16, wherein:
the first side trim comprises:
a trim body fixed to the door panel;
a trim protrusion extending from the trim body to a rear side of the door panel; and
a trim groove formed by laterally recessing a portion of the trim protrusion; and
the first chassis comprises a chassis protrusion inserted into the trim groove to support the first side trim.

20. The door of claim 16, wherein:
the door panel further comprises an upper trim arranged on an upper edge of a rear surface; and a lower trim arranged on a lower edge of the rear surface; and
the door body further comprises:
an upper door cap coupled to the upper trim; and
a lower door cap coupled to the lower trim.

* * * * *